US007779909B2

(12) United States Patent
Noel et al.

(10) Patent No.: US 7,779,909 B2
(45) Date of Patent: Aug. 24, 2010

(54) LINER HANGER

(75) Inventors: Gregory Marshall Noel, Katy, TX (US); Robert Lance Cook, Katy, TX (US); Lev Ring, Houston, TX (US); David Paul Brisco, Duncan, OK (US)

(73) Assignee: Enventure Global Technology, LLC, Houston, TX (US)

( * ) Notice: Subject to any disclaimer, the term of this patent is extended or adjusted under 35 U.S.C. 154(b) by 755 days.

(21) Appl. No.: 11/621,129

(22) Filed: Jan. 9, 2007

(65) Prior Publication Data

US 2008/0023194 A1 Jan. 31, 2008

Related U.S. Application Data

(60) Continuation-in-part of application No. 10/483,017, filed as application No. PCT/US02/20256 on Jun. 26, 2002, now Pat. No. 7,168,496, application No. 11/621,129, which is a continuation-in-part of application No. 10/303,992, filed on Nov. 22, 2002, now Pat. No. 7,270,188, which is a continuation-in-part of application No. 09/852,026, filed on May 9, 2001, now Pat. No. 6,561,227, which is a division of application No. 09/454,139, filed on Dec. 3, 1999, now Pat. No. 6,497,289, said application No. 10/303,992 is a continuation-in-part of application No. 09/510,913, filed on Feb. 23, 2000, now Pat. No. 7,357,188, said application No.

(Continued)

(60) Provisional application No. 60/303,740, filed on Jul. 6, 2001, provisional application No. 60/111,293, filed on Dec. 7, 1998, provisional application No. 60/121,702, filed on Feb. 25, 1999, provisional application No. 60/119,611, filed on Feb. 11, 1999, provisional application No. 60/108,558, filed on Nov. 16, 1998, provisional application No. 60/124,042, filed on Mar. 11, 1999, provisional application No. 60/121,841, filed on Feb. 26, 1999, provisional application No. 60/154,047, filed on Sep. 16, 1999, provisional application No. 60/121,907, filed on Feb. 26, 1999, provisional application No. 60/137,998, filed on Jun. 7, 1999, provisional application No. 60/131,106, filed on Apr. 26, 1999.

(51) Int. Cl.
*E21B 43/10* (2006.01)

(52) U.S. Cl. ..... 166/208; 166/384

(58) Field of Classification Search ..... 166/207, 166/208, 380, 382, 384
See application file for complete search history.

(56) References Cited

U.S. PATENT DOCUMENTS 2,422,187 A 6/1947 Edgar (Continued)

OTHER PUBLICATIONS

PCT International Search Report and Written Opinion, Nov. 26, 2008.

*Primary Examiner*—Daniel P Stephenson
(74) *Attorney, Agent, or Firm*—Conley Rose, P.C.

(57) ABSTRACT

Methods and apparatus for radially expanding a tubular member.

8 Claims, 23 Drawing Sheets

Related U.S. Application Data

(60) 10/303,992 is a continuation-in-part of application No. 09/502,350, filed on Feb. 10, 2000, now Pat. No. 6,823,937, said application No. 10/303,992 is a continuation-in-part of application No. 09/969,922, filed on Oct. 3, 2001, now Pat. No. 6,634,431, which is a continuation of application No. 09/440,338, filed on Nov. 15, 1999, now Pat. No. 6,328,113, said application No. 10/303,992 is a continuation-in-part of application No. 10/169,434, filed on Feb. 18, 2003, now Pat. No. 7,603,758, and a continuation-in-part of application No. 09/523,460, filed on Mar. 10, 2000, now abandoned, said application No. 10/303,992 is a continuation-in-part of application No. 09/512,895, filed on Feb. 24, 2000, now Pat. No. 6,568,471, said application No. 10/303,992 is a continuation-in-part of application No. 09/511,941, filed on Feb. 24, 2000, now Pat. No. 6,575,240, said application No. 10/303,992 is a continuation-in-part of application No. 09/588,946, filed on Jun. 7, 2000, now Pat. No. 6,557,640, said application No. 10/303,992 is a continuation-in-part of application No. 09/559,122, filed on Apr. 26, 2000, now Pat. No. 6,604,763.

(56) References Cited

U.S. PATENT DOCUMENTS

| | | | | |
|---|---|---|---|---|
| 5,526,732 | A | 6/1996 | Stojic | |
| 2004/0045718 | A1* | 3/2004 | Brisco et al. | 166/380 |
| 2004/0065446 | A1* | 4/2004 | Tran et al. | 166/384 |
| 2004/0216873 | A1* | 11/2004 | Frost et al. | 166/250.01 |
| 2009/0229835 | A1* | 9/2009 | Filippov | 166/380 |

* cited by examiner

LINER HANGER

CROSS-REFERENCE TO RELATED APPLICATIONS

This application is a continuation-in-part of U.S. patent application Ser. No. 10/483,017, filed on Jan. 6, 2004, which is a national stage filing of PCT patent application PCT US02/20256, filed on Jun. 26, 2002, which claims the benefit of the filing date of U.S. Provisional Patent Application No. 60/303,740, filed on Jul. 6, 2001, the disclosures of which are incorporated herein by reference.

This application is also a continuation-in-part of U.S. patent application Ser. No. 10/303,992, filed on Nov. 22, 2002, which is a continuation-in-part of the following patent applications: (1) U.S. patent application Ser. No. 09/852,026, filed on May 9, 2001, (now U.S. Pat. No. 6,561,227, which issued May 13, 2003), which was a divisional application of U.S. patent application Ser. No. 09/454,139, filed on Dec. 3, 1999, (now U.S. Pat. No. 6,497,289, which issued Dec. 24, 2002), which claimed the benefit of the filing date of U.S. Provisional Patent Application No. 60/111,293, filed on Dec. 7, 1998; (2) U.S. patent application Ser. No. 09/510,913, filed on Feb. 23, 2000, which claimed the benefit of the filing date of U.S. Provisional Application No. 60/121,702, filed on Feb. 25, 1999; (3) U.S. patent application Ser. No. 09/502,350, filed on Feb. 10, 2000, (now U.S. Pat. No. 6,823,937, which issued Nov. 30, 2004), which claimed the benefit of the filing date of U.S. Provisional Application No. 60/119,611; (4) U.S. patent application Ser. No. 09/969,922, filed on Oct. 3, 2001, (now U.S. Pat. No. 6,634,431, which issued Oct. 21, 2003), which was a continuation of U.S. patent application Ser. No. 09/440,338, filed on Nov. 15, 1999, (now U.S. Pat. No. 6,328,113, which issued Dec. 11, 2002), which claimed the benefit of the filing date of U.S. Provisional Application No. 60/108,558, filed on Nov. 16, 1998; (5) U.S. patent application Ser. No. 10/169,434, filed on Jul. 1, 2002, which claimed the benefit of the filing date of U.S. Provisional Patent Application No. 60/183,546, filed on Feb. 18, 2000; (6) U.S. patent application Ser. No. 09/523,460, filed on Mar. 10, 2000, (now U.S. Pat. No. 6,640,903, which issued Nov. 4, 2003), which claimed the benefit of the filing date of U.S. Provisional Application No. 60/124,042, filed on Mar. 11, 1999; (7) U.S. patent application Ser. No. 09/512,895, filed on Feb. 24, 2000, (now U.S. Pat. No. 6,568,471, which issued May 27, 2003), which claimed the benefit of the filing dates of U.S. Provisional Application No. 60/121,841, filed on Feb. 26, 1999 and U.S. Provisional Application No. 60/154,047, filed on Sep. 16, 1999; (8) U.S. patent application Ser. No. 09/511,941, filed on Feb. 24, 2000, (now U.S. Pat. No. 6,575,240, which issued Jun. 10, 2003), which claimed the benefit of the filing date of U.S. Provisional Patent Application No. 60/121,907, filed on Feb. 26, 1999; (9) U.S. patent application Ser. No. 09/588,946, filed on Jun. 7, 2000, (now U.S. Pat. No. 6,557,640, which issued May 6, 2003), which claimed the benefit of the filing date of U.S. Provisional Patent Application No. 60/137,998, filed on Jun. 7, 1999; and (10) U.S. patent application Ser. No. 09/559,122, filed on Apr. 26, 2000, (now U.S. Pat. No. 6,604,763, which issued Aug. 12, 2003), which claimed the benefit of the filing date of U.S. Provisional Application No. 60/131,106, filed on Apr. 26, 1999. Applicants incorporate by reference the disclosures of these applications.

This application is also related to the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001; (23) U.S. provisional patent application Ser. No. 60/262,434, filed on Jan. 17, 2001; (24) U.S. provisional patent application Ser. No. 60/259,486, filed on Jan. 3, 2001; and (25) U.S. provisional patent application Ser. No 60/303,711, filed on Jul. 6, 2001, the disclosures of which are incorporated herein by reference.

This application is related to the following co-pending applications: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, now U.S. Pat. No. 6,823,937 which issued Nov. 30, 2004, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. Pat. No. 6,640,903 which was filed as U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, now U.S. Pat. No. 6,695,012 which issued Feb. 24, 2004, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/322,947, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, now U.S. Pat. No. 6,976,541 which issued Dec. 20, 2005, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, now U.S. Pat. No. 6,892,819 which issued May 17, 2005, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (41) U.S. patent application Ser. No. 09/962,471, filed on Sep. 25, 2001, now U.S. Pat. No. 6,739,392 which issued May 25, 2004, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (42) U.S. patent application Ser. No. 09/962,467, filed on Sep. 25, 2001, now U.S. Pat. No. 6,725,919 which issued Apr. 27, 2004, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (43) U.S. patent application Ser. No. 09/962,468, filed on Sep. 25, 2001, now U.S. Pat. No. 6,758,278 which issued Jul. 6, 2004, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, now U.S. Pat. No. 6,745,845 which issued Jun. 8, 2004, filed on Dec. 10, 2001, which is a continuation application of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, now U.S. Pat. No. 6,705,395 which issued Mar. 16, 2004, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, now U.S. Pat. No. 6,631,759 which issued Oct. 14, 2003, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, now U.S. Pat. No. 6,631,769 which issued Oct. 14, 2003, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, now U.S. Pat. No. 7,063,142 which issued Jun. 20, 2006, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, now U.S. Pat. No. 6,684,947 which issued Feb. 3, 2004, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, now U.S. Pat. No. 6,966,370 which issued Nov. 22, 2005, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, now U.S. Pat. No. 7,044,221 which issued May 16, 2006, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, now U.S. Pat. No. 7,011,161 which issued Mar. 14, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, now U.S. Pat. No. 7,040,396 which issued May 9, 2006, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, now U.S. Pat. No. 7,048,062 which issued May 23, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, now U.S. Pat. No. 6,857,473 which issued Feb. 22, 2005, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, now U.S. Pat. No. 7,077,213 which issued Jul. 18, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, now U.S. Pat. No. 7,036,582 which issued May 2, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, now U.S. Pat. No. 7,044,218 which issued May 16, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, now U.S. Pat. No. 6,823,937 which issued Nov. 30, 2004, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. patent application Ser. No. 10/418,687, filed on Apr. 18, 2003, now U.S. Pat. No. 7,021,390 which issued Apr. 4, 2006, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, now U.S. Pat. No. 6,968,618 which issued Nov. 29, 2005, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, now U.S. Pat. No. 7,055,608 which issued Jun. 6, 2006, which was filed on Apr. 18, 2003, as a division of U.S. utility patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999; (122) PCT patent application serial no. PCT/US2004/06246, filed on Feb. 26, 2004; (123) PCT patent application serial number PCT/US2004/08170, filed on Mar. 15, 2004; (124) PCT patent application serial number PCT/US2004/08171, filed on Mar. 15, 2004; (125) PCT patent application serial number PCT/US2004/08073, filed on Mar. 18, 2004; (126) PCT patent application serial number PCT/US2004/07711, filed on Mar. 11, 2004; (127) PCT patent application serial number PCT/US2004/029025, filed on Mar. 26, 2004; (128) PCT patent application serial number PCT/US2004/010317, filed on Apr. 2, 2004; (129) PCT patent application serial number PCT/US2004/010712, filed on Apr. 6, 2004; (130) PCT patent application serial number PCT/US2004/010762, filed on Apr. 6, 2004; (131) PCT patent application serial number PCT/US2004/011973, filed on Apr. 15, 2004; (132) U.S. provisional patent application Ser. No. 60/495,056, filed on Aug. 14, 2003; (133) U.S. provisional patent application Ser. No. 60/600679, filed on Aug. 11, 2004; (134) PCT patent application serial number PCT/US2005/027318, filed on Jul. 29, 2005; (135) PCT patent application serial number PCT/US2005/028936, filed on Aug. 12, 2005; (136) PCT patent application serial number PCT/US2005/028669, filed on Aug. 11, 2005; (137) PCT patent application serial number PCT/US2005/028453, filed on Aug. 11, 2005; (138) PCT patent application serial number PCT/US2005/028641, filed on Aug. 11, 2005; (139) PCT patent application serial number PCT/US2005/028819, filed on Aug. 11, 2005; (140) PCT patent application serial number PCT/US2005/028446, filed on Aug. 11, 2005; (141) PCT patent application serial number PCT/US2005/028642, filed on Aug. 11, 2005; (142) PCT patent application serial number PCT/US2005/028451, filed on Aug. 11, 2005, and (143). PCT patent application serial number PCT/US2005/028473, filed on Aug. 11, 2005, (144) U.S. utility patent application Ser. No. 10/546,082, filed on Aug. 16, 2005, (145) U.S. utility patent application Ser. No. 10/546,076, filed on Aug. 16, 2005, (146) U.S. utility patent application Ser. No. 10/545,936, filed on Aug. 16, 2005, (147) U.S. utility patent application Ser. No. 10/546,079, filed on Aug. 16, 2005 (148) U.S. utility patent application Ser. No. 10/545,941, filed on Aug. 16, 2005, (149) U.S. utility patent application Ser. No. 546,078, filed on Aug. 16, 2005, filed on Aug. 11, 2005, (150) U.S. utility patent application Ser. No. 10/545,941, filed on Aug. 16, 2005, (151) U.S. utility patent application Ser. No. 11/249,967, filed on Oct. 13, 2005, (152) U.S. provisional patent application Ser. No. 60/734,302, filed on Nov. 7, 2005, (153) U.S. provisional patent application Ser. No. 60/725,181, filed on Oct. 11, 2005, (154) PCT patent application serial number PCT/US2005/023391, filed Jun. 29, 2005 which claims priority from U.S. provisional patent application Ser. No. 60/585,370, filed on Jul. 2, 2004, (155) U.S. provisional patent application Ser. No. 60/721,579, filed on Sep. 28, 2005, (156) U.S. provisional patent application Ser. No. 60/717,391, filed on Sep. 15, 2005, (157) U.S. provisional patent application Ser. No. 60/702,935, filed on Jul. 27, 2005, (158) U.S. provisional patent application Ser. No. 60/663,913, filed on Mar. 21, 2005, (159) U.S. provisional patent application Ser. No. 60/652,564, filed on Feb. 14, 2005, (160) U.S. provisional patent application Ser. No. 60/645,840, filed on Jan. 21, 2005, (161) PCT patent application serial number PCT/US2005/043122, filed on Nov. 29, 2005 which claims priority from U.S. provisional patent application Ser. No. 60/631,703, filed on Nov. 30, 2004, (162) U.S. provisional patent application Ser. No. 60/752,787, filed on Dec. 22, 2005, (163) U.S. National Stage application Ser. No. 10/548,934, filed on Sep. 12, 2005; (164) U.S. National Stage application Ser. No. 10/549,410, filed on Sep. 13, 2005; (165) U.S. Provisional Patent Application No. 60/717,391, filed on Sep. 15, 2005; (166) U.S. National Stage application Ser. No. 10/550,906, filed on Sep. 27, 2005; (167) U.S. National Stage application Ser. No. 10/551,880, filed on Sep. 30, 2005; (168) U.S. National Stage application Ser. No. 10/552,253, filed on Oct. 4, 2005; (169) U.S. National Stage application Ser. No. 10/552,790, filed on Oct. 11, 2005; (170) U.S. Provisional Patent Application No. 60/725,181, filed on Oct. 11, 2005; (171) U.S. National Stage application Ser. No. 10/553,094, filed on Oct. 13, 2005; (172) U.S. National Stage application Ser. No. 10/553,566, filed on Oct. 17, 2005; (173) PCT Patent Application No. PCT/US2006/002449, filed on Jan. 20, 2006, (174) PCT Patent Application No. PCT/US2006/004809, filed on Feb. 9, 2006; (175) U.S. Utility patent application Ser. No. 11/356,899, filed on Feb. 17, 2006, (176) U.S. National Stage application Ser. No. 10/568,200, filed on Feb. 13, 2006, (177) U.S. National Stage application Ser. No. 10/568,719, filed on Feb. 16, 2006, (178) U.S. National Stage application Ser. No. 10/569,323, filed on Feb. 17, 2006, (179) U.S. National State patent application Ser. No. 10/571,041, filed on Mar. 3, 2006; (180) U.S. National State patent application Ser. No. 10/571,017, filed on Mar. 3, 2006; (181) U.S. National State patent application Ser. No. 10/571,086, filed on Mar. 6, 2006; and (182) U.S. National State patent application Ser. No. 10/571,085, filed on Mar. 6, 2006, (183) U.S. utility patent application Ser. No. 10/938,788, filed on Sep. 10, 2004, (184) U.S. utility patent application Ser. No. 10/938,225, filed on Sep. 10, 2004, (185) U.S. utility patent application Ser. No. 10/952,288, filed on Sep. 28, 2004, (186) U.S. utility patent application Ser. No. 10/952,416, filed on Sep. 28, 2004, (187) U.S. utility patent application Ser. No. 10/950,749, filed on Sep. 27, 2004, (188) U.S. utility patent application Ser. No. 10/950,869, filed on Sep. 27, 2004; (189) U.S. provisional patent application Ser. No. 60/761,324, filed on Jan. 23, 2006, (190) U.S. provisional patent application Ser. No. 60/754,556, filed on Dec. 28, 2005, (191) U.S. utility patent application Ser. No. 11/380,051, filed on Apr. 25, 2006, (192) U.S. utility patent application Ser. No. 11/380,055, filed on Apr. 25, 2006, (193) U.S. utility patent application Ser. No. 10/522,039, filed on Mar. 10, 2006; (194) U.S. provisional patent application Ser. No. 60/746,813, filed on May 9, 2006; (195) U.S. utility patent application Ser. No. 11/456,584, filed on Jul. 11, 2006; and (196) U.S. utility patent application Ser. No. 11/456,587, filed on Jul. 11, 2006; (197) PCT Patent Application No. PCT/US2006/009886, filed on Mar. 21, 2006; (198) PCT Patent Application No. PCT/US2006/010674, filed on Mar. 21, 2006; (199) U.S. Pat. No. 6,409,175 which issued Jun. 25, 2002; (200) U.S. Pat. No. 6,550,821 which issued Apr. 22, 2003; (201) U.S. patent application Ser. No. 10/767,953, filed Jan. 29, 2004, now U.S. Pat. No. 7,077,211 which issued Jul. 18, 2006; (202) U.S. patent application Ser. No. 10/769,726, filed Jan. 30, 2004; (203) U.S. patent application Ser. No. 10/770,363 filed Feb. 2, 2004; (204) U.S. utility patent application Ser. No. 11/068,595, filed on Feb. 28, 2005; (205) U.S. utility patent application Ser. No. 11/070,147, filed on Mar. 2, 2005; (206) U.S. utility patent application Ser. No. 11/071,409, filed on Mar. 2, 2005; (207) U.S. utility patent application Ser. No. 11/071,557, filed on Mar. 3, 2005; (208) U.S. utility patent application Ser. No. 11/072,578, filed on Mar. 4, 2005; (209) U.S. utility patent application Ser. No. 11/072,893, filed on Mar. 4, 2005; (210) U.S. utility patent application Ser. No. 11/072,594, filed on Mar. 4, 2005; (211) U.S. utility patent application Ser. No. 11/074,366, filed on Mar. 7, 2005; (212) U.S. utility patent application Ser. No. 11/074,266, filed on Mar. 7, 2005, (213) U.S. provisional patent application Ser. No. 60/832,909, filed on Jul. 24, 2006, (214) U.S. utility patent application Ser. No. 11/536,302, filed Sep. 28, 2006, (215) U.S. utility patent application Ser. No. 11/538,228, filed Oct. 3, 2006, (216) U.S. utility patent application Ser. No. 11/552,703, filed on Oct. 25, 2006, (217) U.S. utility application Ser. No. 11/553,240, filed on Oct. 26, 2006, (218) U.S. utility application Ser. No. 11/554,288, filed on Oct. 30, 2006, (219) U.S. utility application Ser. No. 11/560,154, filed on Nov. 15, 2006, (220) U.S. provisional application Ser. No. 60/866,536, filed on Nov. 20, 2006, and (221) U.S. provisional application Ser. No. 60/866,543, filed on Nov. 20, 2006.

BACKGROUND

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement, a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

BRIEF DESCRIPTION OF THE DRAWINGS

The present disclosure is best understood from the following detailed description when read with the accompanying figures. It is emphasized that, in accordance with the standard practice in the industry, various features may not be drawn to scale. In fact, the dimensions of the various features may be arbitrarily increased or reduced for clarity of discussion.

DETAILED DESCRIPTION OF THE ILLUSTRATIVE EMBODIMENTS

An apparatus and method for plastically deforming a tubular liner within a wellbore within a subterranean formation is provided. The apparatus and method thereby provides a system for coupling a radially expandable tubular liner to an open hole or cased section of a wellbore within a subterranean formation. Furthermore, in this manner, a wellbore casing, a pipeline, or a structural support may be formed or repaired using the present illustrative embodiments.

Figure 1:
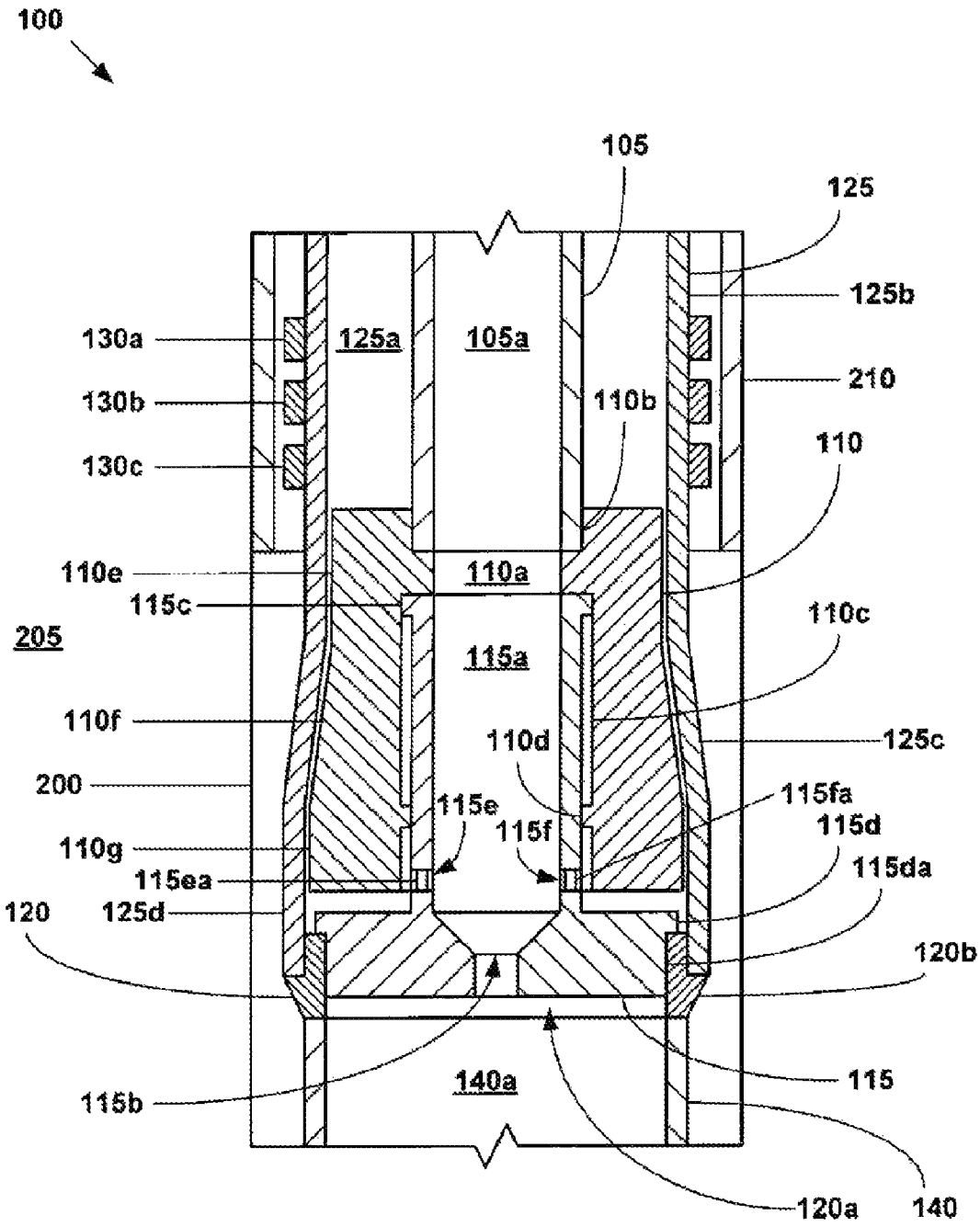
FIG. 1 is a fragmentary cross-sectional illustration of an embodiment of a liner hanger positioned within a wellbore including a preexisting section of wellbore casing.

Referring initially to FIG. 1, an embodiment of an apparatus 100 for radially expanding and plastically deforming a tubular liner includes a tubular support member 105 that defines a passage 105*a* that is coupled to a tubular expansion cone 110 that defines a passage 110*a* and includes a recess 110*b* for mating with and receiving the tubular support member 105, a recess 110*c*, and an internal flange 110*d*. The tubular expansion cone 110 further includes a first section 110*e* having a substantially cylindrical outer surface, a second section 110*f* having a substantially tapered conical outer surface, and a third section 110*g* having a substantially cylindrical outer surface. In an exemplary embodiment, the outside diameter of the first section 110*e* is greater than the outside diameter of the third section 110*g*. In an exemplary embodiment, the recess 110*b* includes internal threads and the end of the tubular support member 105 that is received within the recess 110*b* includes external threads for engaging the internal threads.

An end of a tubular shoe 115 mates with and is movably received within the recess 110*c* of the tubular expansion cone 110 that defines a passage 115*a* and a valveable passage 115*b* and includes an external flange 115*c*, and an external flange 115*d* including a recessed portion 115*da*. The tubular shoe 115 further includes radial passages 115*e* and 115*f* for receiving corresponding burst discs, 115*ea* and 115*fa*. An end of a tubular support member 120 that defines a passage 120*a* mates with and is movably received within the recess 115*da* of the external flange 115*d* of the tubular shoe 115 and includes an external flange 120*b* having a substantially conical outer surface.

An end of an expandable tubular member 125 mates with and is coupled to the tubular support member 120 that defines a passage 125*a* for receiving the tubular support member 105, the tubular expansion cone 110, and the tubular shoe 115. In an exemplary embodiment, the end of the expandable tubular member 125 is coupled to the tubular support member 120 by a conventional threaded connection. In an exemplary embodiment, the expandable tubular member 125 includes a first section 125*b* having a substantially cylindrical outer surface, a second section 125*c* having a substantially conical outer surface, and a third section 125*d* having a substantially cylindrical outer surface. In an exemplary embodiment, the outside diameter of the first section 125*b* is greater than the outside diameter of the third section 125*d*, and a plurality of tubular sealing members, 130*a*, 130*b*, and 130*c*, are coupled to the external surface of the first section 125*b* of the expandable tubular member 125.

An end of a tubular member 140 that defines a passage 140*a* is coupled to an end of the tubular support member 120. In an exemplary embodiment, the connection between the tubular member 140 and the tubular support member 120 is a conventional threaded connection.

In an exemplary embodiment, as illustrated in FIG. 1, the apparatus 100 may be positioned within a wellbore 200 within a subterranean formation 205 that includes a preexisting section of wellbore casing 210. The wellbore 200 may be vertical, horizontal, or an intermediate orientation.

Figure 2:
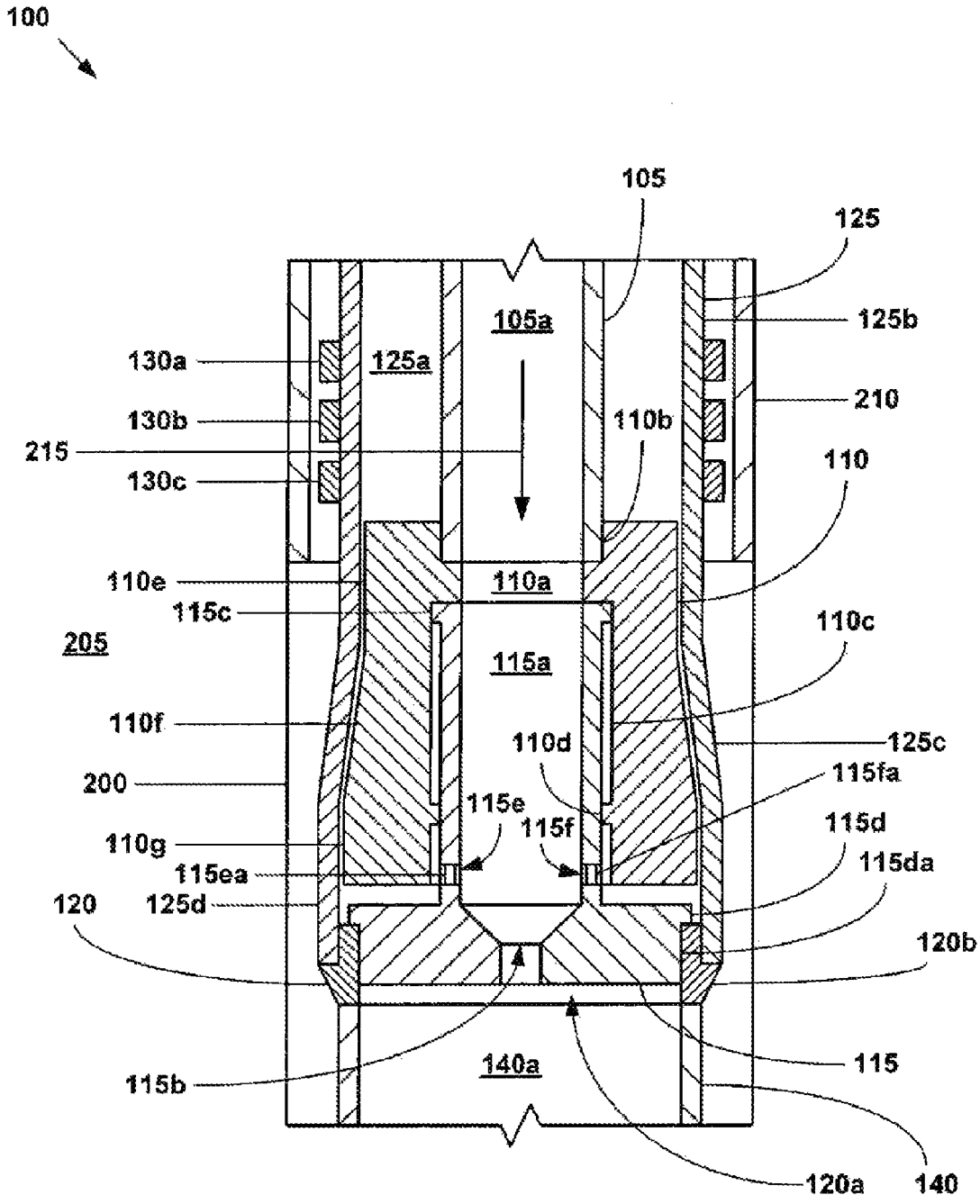
FIG. 2 is a fragmentary cross-sectional illustration of the injection of a fluidic material into the apparatus of FIG. 2.

As illustrated in FIG. 2, a fluidic material 215 may then be injected into the apparatus 100 through the passages 105*a*, 110*a*, 115*a*, 115*b*, and 140*a* in order to ensure the proper operation of the passages. In an alternative embodiment, before or after the injection of the fluidic material 215, a hardenable fluidic sealing material such as, for example, cement, may be injected into the apparatus 100, through the passages 105*a*, 110*a*, 115*a*, 115*b*, and 140*a*, in order to form an annular body of a fluidic sealing material between the tubular member 125 and the wellbore 200.

Figure 3:
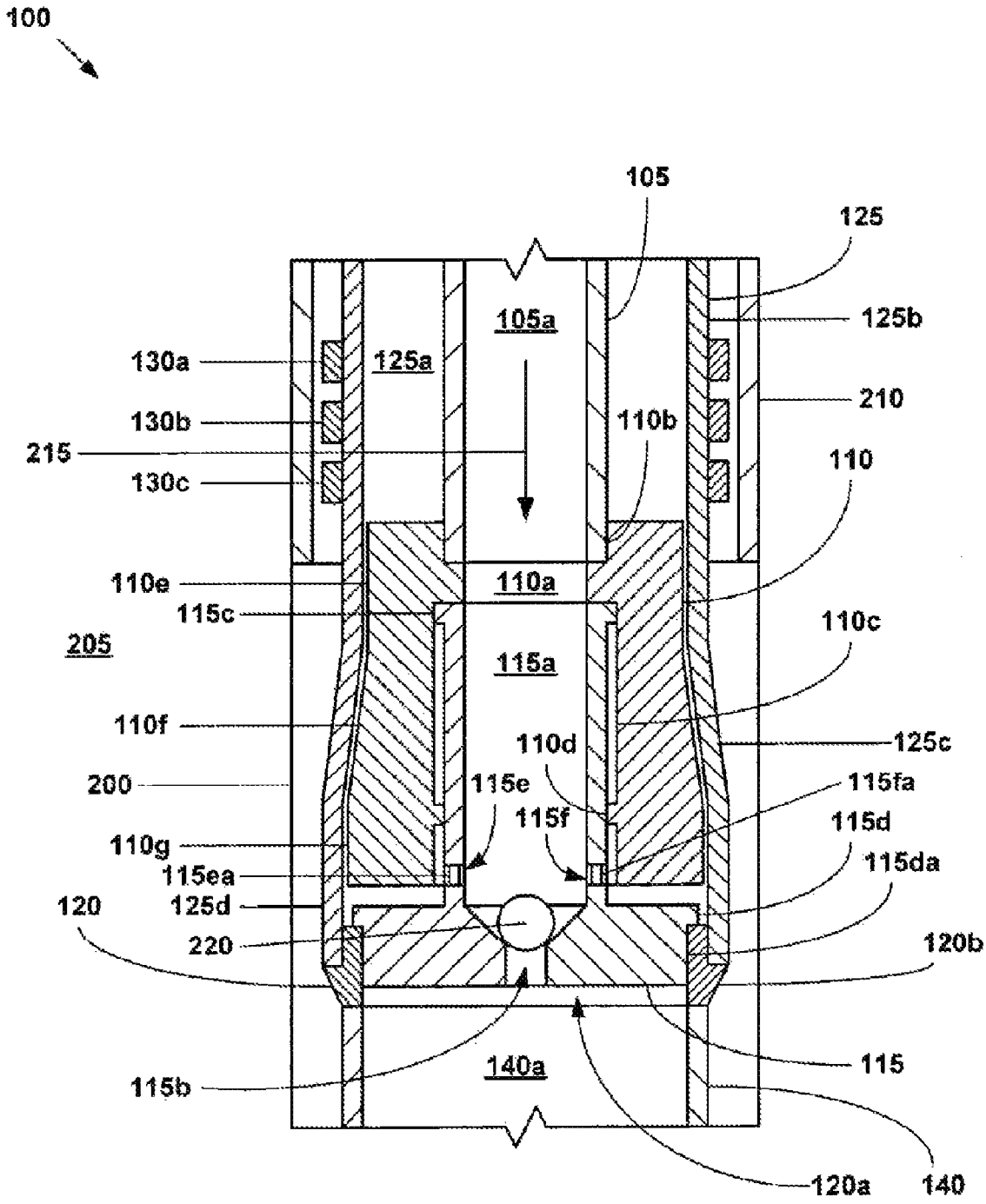
FIG. 3 is a fragmentary cross-sectional illustration of the placement of a ball into the valveable passage of the tubular shoe of the apparatus of FIG. 2.

As illustrated in FIG. 3, a ball 220 may then be placed into the valveable passage 115*b* of the tubular shoe 115 by introducing the ball into the injected fluidic material 215. In this manner, the valveable passage 115*b* of the tubular shoe 115 may be sealed off thereby permitting the passage 115*a* to be pressurized by the continued injection of the fluidic material 215.

Figure 4:
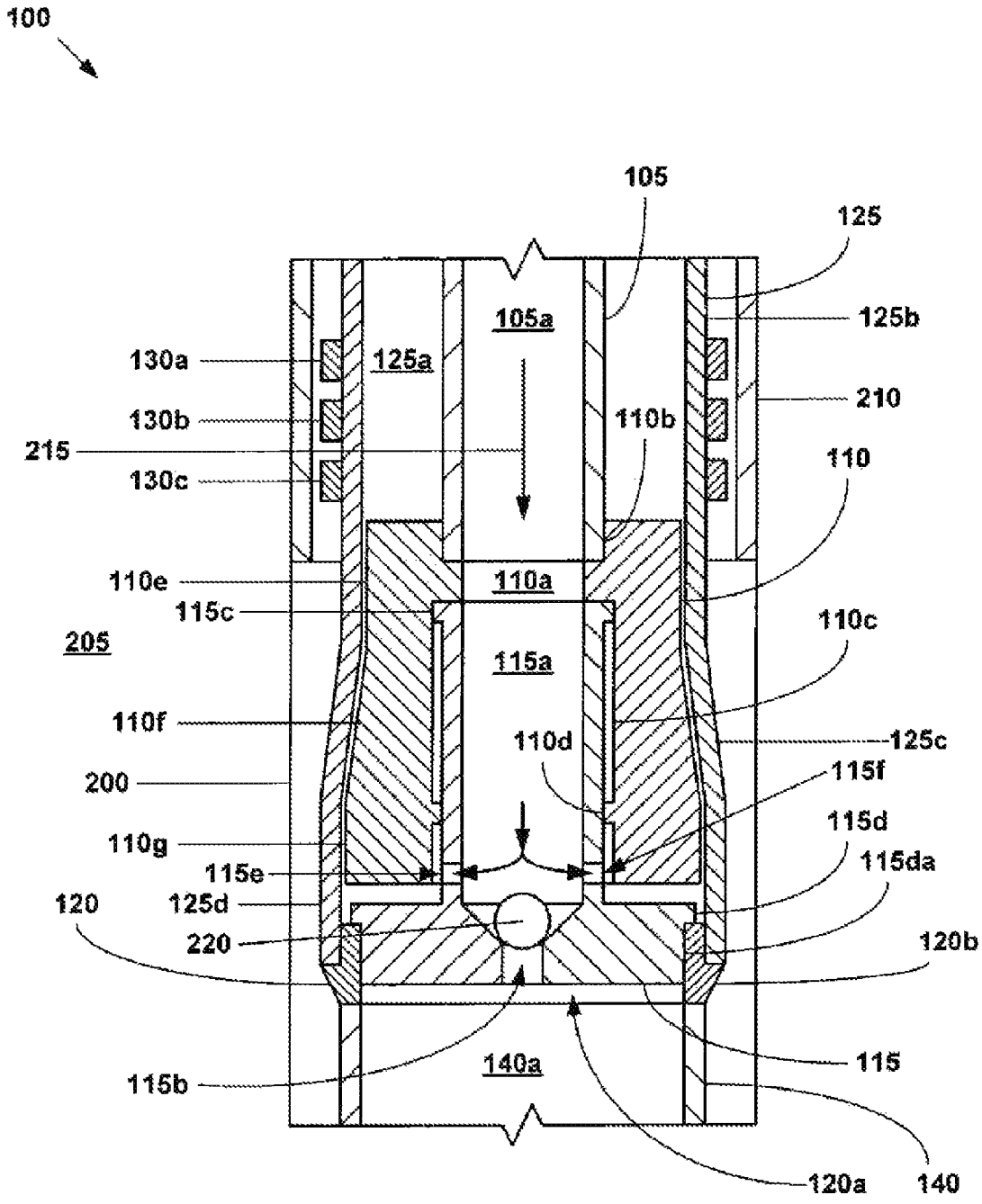
FIG. 4 is a fragmentary cross-sectional illustration of the continued injection of the fluidic material into the apparatus of FIG. 3 in order to burst the burst discs.

As illustrated in FIG. 4, the continued injection of the fluidic material 215 will burst the burst discs 115*ea* and 115*fa* thereby permitting the injected fluidic material to pass through the radial passages 115*e* and 115*f* into the annular region between the tubular shoe 115 and the expandable tubular member 125 below the tubular expansion cone 110 above the external flange 115*d* of the tubular shoe.

Figure 5:
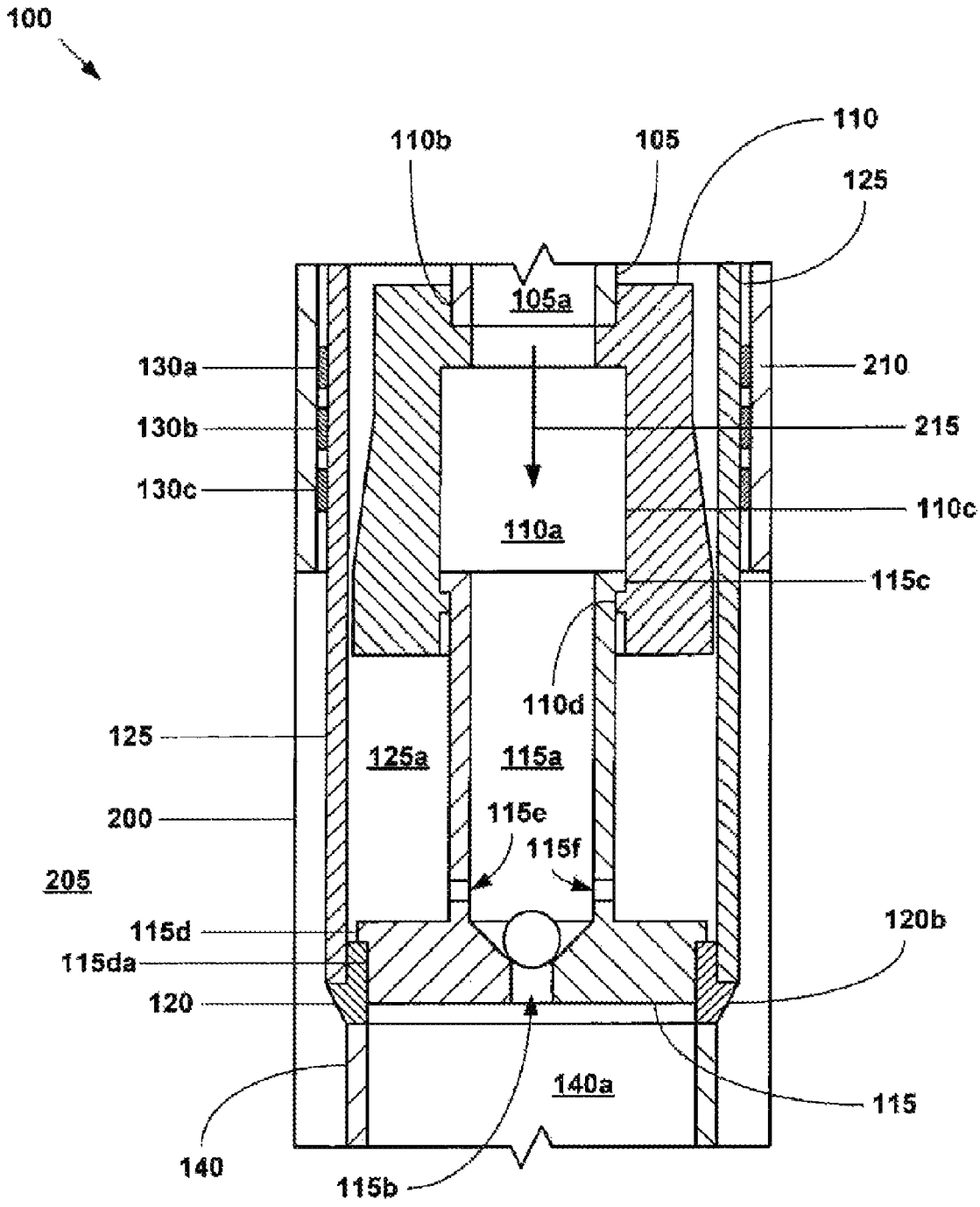
FIG. 5 is a fragmentary cross-sectional illustration of the continued injection of the fluidic material into the apparatus of FIG. 4 in order to plastically deform and radially expand the expandable tubular member.

As illustrated in FIG. 5, the continued injection of the fluidic material 215 will continue to pressurize the annular region, between the tubular shoe 115 and the expandable tubular member 125 below the tubular expansion cone 110 above the external flange 115*d* of the tubular shoe, and thereby extrude the expandable tubular member 125 off of the tubular expansion cone 110 by plastically deforming and radially expanding the expandable tubular member.

During the continued radial expansion of the expandable tubular member 125, the tubular support member 105 and the tubular expansion cone 110 may be raised out of the wellbore 200. Because the tubular expansion cone 110 and the tubular shoe 115 are movably coupled, the axial displacement of the tubular expansion cone 110 during the radial expansion of the tubular member 125 does not displace the tubular shoe in the axial direction. In an exemplary embodiment, during the radial expansion and plastic deformation of the expandable tubular member 125, the tubular shoe 120 is supported by the tubular support member 120 in the axial direction.

In an exemplary embodiment, the radial expansion of the expandable tubular member 125 further causes the sealing members, 130*a*, 130*b*, and 130*c*, to engage the preexisting wellbore casing 210. In this manner, the radially expanded tubular member 125, the tubular support member 120, and the tubular member 140 are coupled to the preexisting wellbore casing. Furthermore, in this manner, a fluidic seal is provided between the radially expanded tubular member 125 and the preexisting wellbore casing 210.

Figure 6:
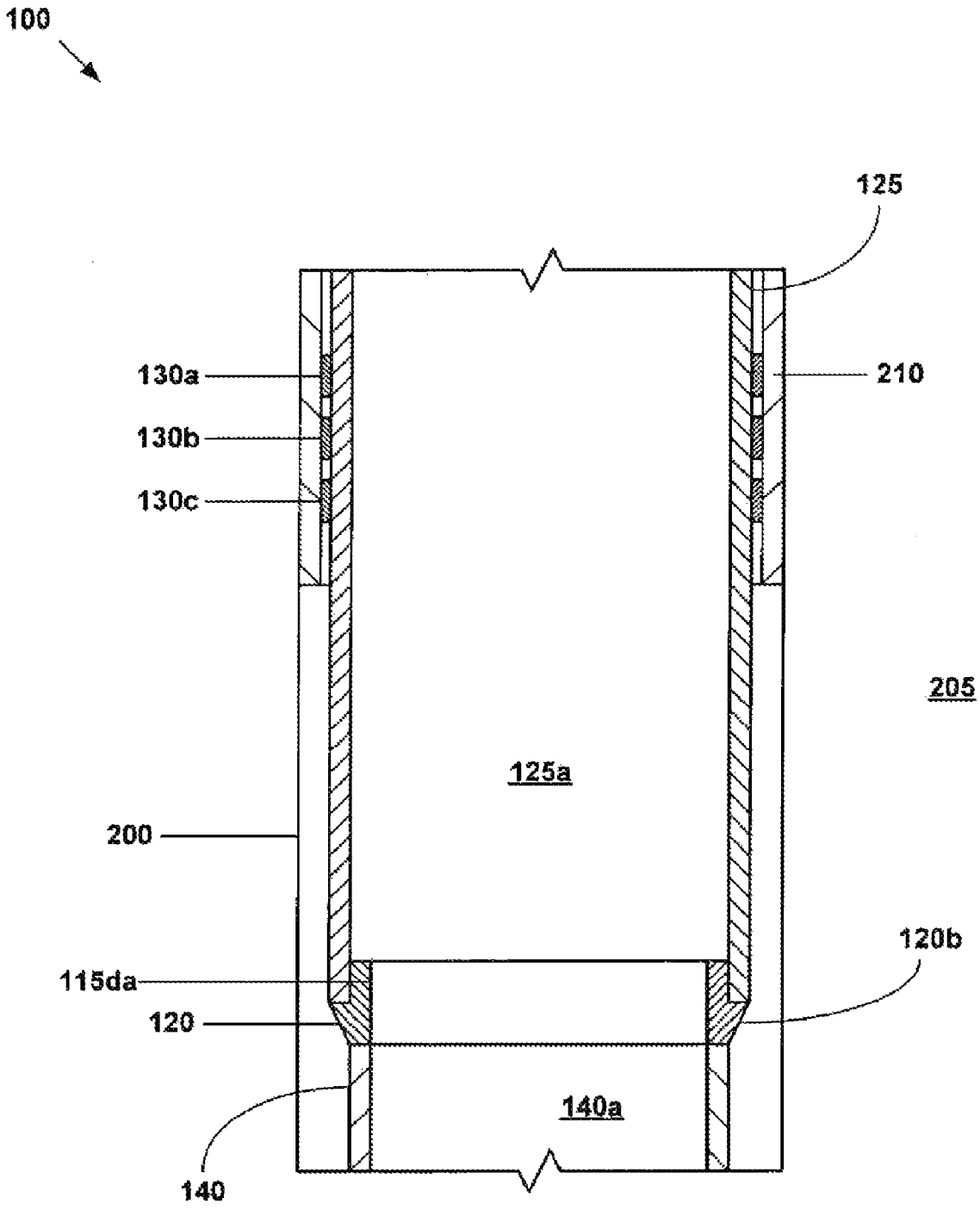
FIG. 6 is a fragmentary cross-sectional illustration of the completion of the radial expansion and plastic deformation of the expandable tubular member of the apparatus of FIG. 5.

As illustrated in FIG. 6, once the radial expansion of the expandable tubular member 125 has been completed, the tubular support member 105, the tubular expansion cone 110, and the tubular shoe 115 are removed from the wellbore 200. In particular, the external flange 115*c* of the tubular shoe 115 engages the internal flange 110*d* of the tubular expansion cone 110 thereby permitting the tubular shoe to be removed from the wellbore 200.

In a preferred embodiment, the apparatus 100, and method of operating the apparatus, is provided substantially as disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial No. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270.007, filed on Feb. 20, 2001; (23) U.S. provisional patent application Ser. No. 60/262,434, filed on Jan. 17, 2001; (24) U.S. provisional patent application Ser. No. 60/259,486, filed on Jan. 3, 2001; and (25) U.S. provisional patent application Ser. No. 60/303,711, filed on Jul. 6, 2001, the disclosures of which are incorporated herein by reference.

Figure 7:
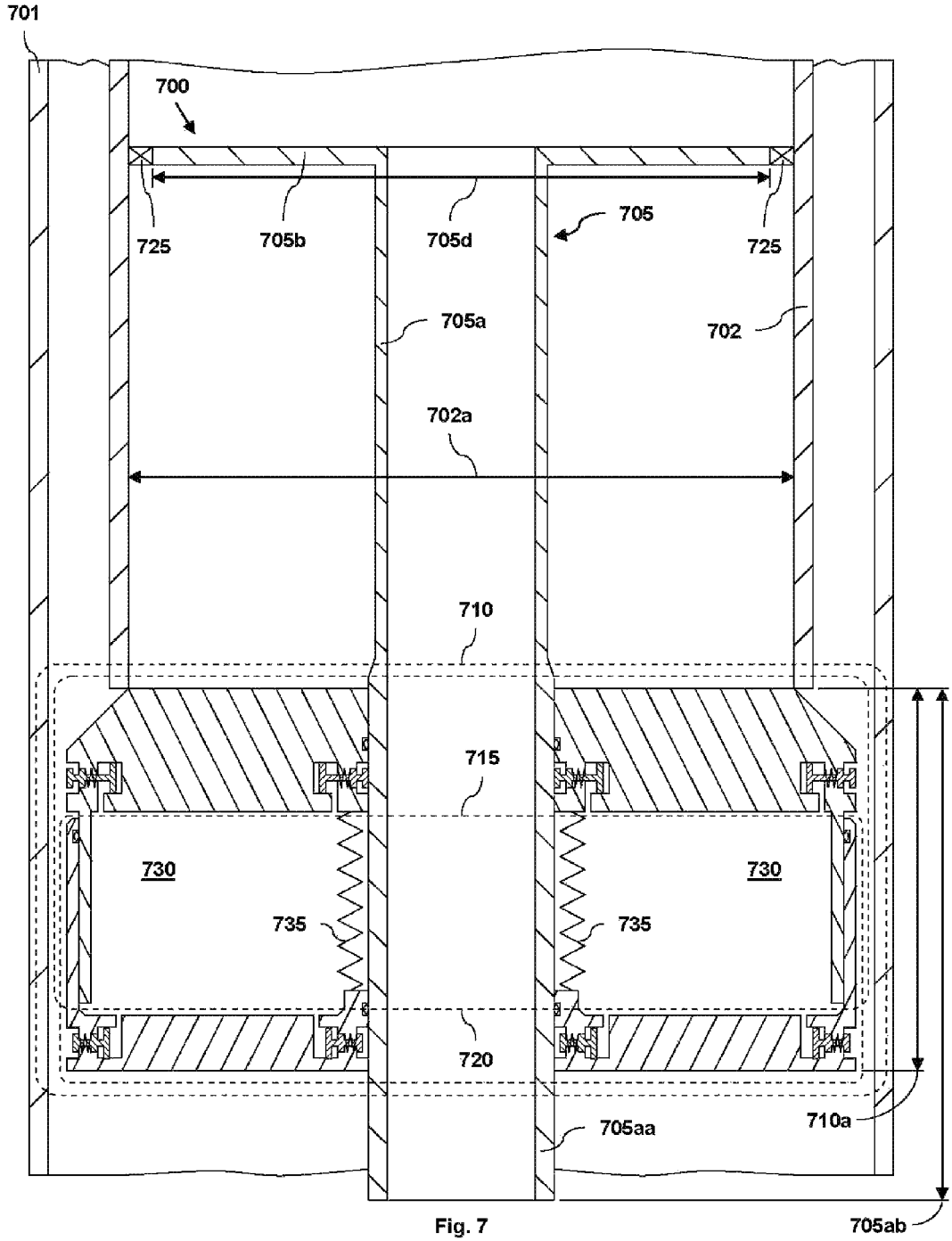
FIG. 7 is a fragmentary cross-sectional illustration of apparatus according to one or more aspects of the present disclosure.

Referring to FIG. 7, illustrated is an embodiment of an apparatus 700 for radially expanding and plastically deforming an expandable tubular member 702 according to one or more aspects of the present disclosure. The apparatus 700 comprises a support member 705 and an expansion device 710. The expansion device comprises an anchor 715 and a die 720. The anchor 715 may also be referred to herein as an anchor portion, a base, or a base portion, and the die 720 may also be referred to herein as a die portion, a former, or a former portion. The apparatus 700 also includes one or more pressure chambers 730, such as a circular annulus-shaped pressure chamber 730 that may be defined between internal surfaces of the anchor 715 and the die 720. The apparatus 700 also includes one or more biasing elements 735 each comprising one or more springs or other mechanical biasing elements.

Alternatively, or additionally, the biasing elements 735 may each be hydraulically, magnetically, and/or electrically operable.

The support member 705 is configured to be run down a casing or a partially or wholly cased or uncased wellbore (such casing or wellbore indicated in FIG. 7 by reference number 701) via E-line, slick line, flexible tubing, and/or other means. The support member 705 has a metallic or other rigid construction, and includes a central portion 705*a* and an annulus-shaped flange portion 705*b* located at or near an upper end of the central portion 705*a*.

The central portion 705*a* may be solid or tubular, and includes a portion 705*aa* having a larger outer diameter relative to the remainder of the central portion 705*a*. The support member 705 is axially positioned relative to the expandable tubular member 702 such that the portion 705*aa* extends from the bottom end of the expandable tubular member 702 to a length 705*ab* substantially similar to or greater than a collapsed height 710*a* of the expansion device 710. The flange portion 705*b* has an outer diameter 705*d* that is substantially similar to or slightly smaller than an inner diameter or passage 702*a* of the expandable tubular member 702 prior to radial expansion. The central portion 705*a* and the flange portion 705*b* may be integrally formed, such as by forging or machining from a single billet of metal round stock, or they may be discrete components coupled together by welding, press-fitting, mechanical fasteners and/or other means. The outer diameter of the portion 705*aa* of the support member 705 that extends from the bottom of the expandable tubular member 702 may be 0.5" to 2.0" greater than the outer diameter of the remainder of the central portion 705*a* of the support member 705. However, other embodiments are also within the scope of the present disclosure.

Detachable coupling means 725 secure the support member 705 to the inside of the expandable tubular member 702. The detachable coupling means 725 may be or include one or more packers, tack welds, mechanical fasteners, mechanical fuses, and/or other means by which the axial position of the support member 705 may be at least temporarily fixed relative to the expandable tubular member 702. The detachable coupling means 725 may also be configured to allow the support member 705 to slide axially within the expandable tubular member 702 when acted upon by a sufficient axial force.

In an alternative embodiment (not shown in FIG. 7), the central portion 705*a* of the support member 705 may extend beyond the upper end of the expandable tubular member 702, and the flange portion 705*b* may overlap the upper end of the expandable tubular member 702, such as where the outer diameter 705*d* of the flange portion 705*b* is substantially similar to or at least slightly larger than the outer diameter of the expandable tubular member 702. Nonetheless, the axial position of the support member 705 relative to the expandable tubular member 702 may still be at least temporarily fixed, such as by one or more tack welds, mechanical fasteners, mechanical fuses, and/or other means detachably coupling the support member 705 to the expandable tubular member 702.

Figure 8:
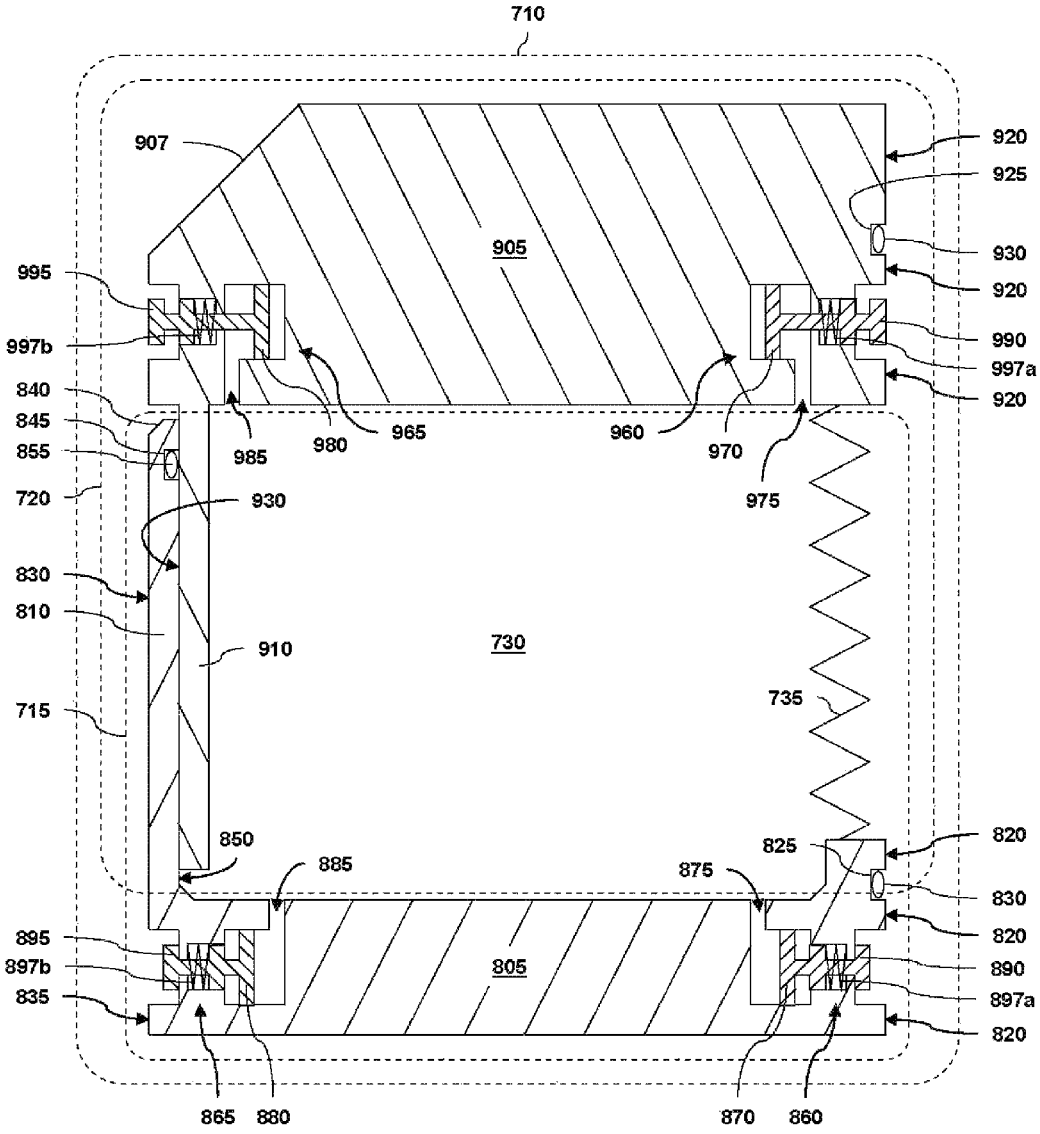
FIG. 8 is an enlarged view of a portion of the apparatus of FIG. 7.

Referring to FIG. 8, illustrated is an enlarged view of a portion of the expansion device 710 shown in FIG. 7. The expansion device 710 may be substantially symmetrical, at least with regard to the aspects described below, such that only one half of the cross-sectional view of FIG. 7 is shown in FIG. 8.

The anchor 715 includes a body 805 and an extension 810. The body 805 may be substantially disk-shaped except as described herein and depicted in FIG. 8. For example, the body 805 comprises a central aperture configured to slidably receive the support member 705 shown in FIG. 7. Several portions of the boundary, perimeter, surface or diameter of the central aperture are indicated by reference numeral 820 in FIG. 8. The body 805 may also include one or more recesses 825 in the surface 820 defined by the central aperture. Each recess 825 may be sized and otherwise configured to receive and possibly retain an o-ring and/or other sealing element 830. Accordingly, fluid flow past the sealing element 830 between the body 805 and the support member 705 may be prevented.

The extension 810 may be substantially tubular, ring- or annulus-shaped, extending upward from the body 805. The extension 810 may be integrally formed with the body 805, such as by forging or machining from a single billet of metal round stock, or the extension 810 may be a discrete component coupled to the body 805 by welding, press-fitting, mechanical fasteners and/or other means. The extension 810 may have an aspect ratio (height:width) of at least about 2:1, and possibly as great as 10:1, 20:1 or more. The height or axial length of the extension 810 may be at least about 4 inches, and possibly as great as 20 feet or more. The outer surface or diameter 830 of the extension 810 may be co-cylindrical with the outer surface or diameter 835 of the body 805. That is, the body 805 and the extension 810 may be coaxial and have the same outer diameter. An upper, outside edge of the extension 810 may comprise a chamfer 840 and/or otherwise be tapered or rounded.

The extension 810 may include one or more recesses 845 in the inner surface or diameter 850. Each recess 845 may be sized and otherwise configured to receive and possibly retain an o-ring and/or other sealing element 855. Each recess 845 may be substantially similar to the one or more recesses 825. Accordingly, fluid flow past the sealing element 855 between the extension 810 and an extension 910 of the die 720 may be prevented.

The anchor 715 also includes at least one internal brake 860 and at least one external brake 865. The internal and external brakes 860, 865 may each operate as a function of pressure, such as in response to the pressure within the pressure chamber 730 nearing, exceeding, or falling below a predetermined value. The internal brake 860 is configured to selectively engage the support member 705, such as by selectively exerting a radially inward force on the support member 705. The external brake 865 is configured to selectively engage the expandable tubular member 702, such as by selectively exerting a radially outward force on the expandable tubular member 702. The internal and external brakes 860, 865 may each comprise mechanical, hydraulic, magnetic and/or electrical means for selectively engaging the support member 702 and/or the expandable tubular member 702.

In an exemplary embodiment, the internal brake 860 includes a hydraulic piston 870 fluidicly coupled to the pressure chamber 730, such as via port 875, and the external brake 865 includes a hydraulic piston 880 fluidicly coupled to the pressure chamber 730, such as via port 885. An internal shoe or stop 890 is integral or coupled to the piston 870, and is configured to exert a radially inward force on the support member 705. An external shoe or stop 895 is integral or coupled to the piston 880, and is configured to exert a radially outward force on the expandable tubular member 702. Springs and/or other biasing means 897*a*, 897*b* may urge the shoes 890, 895 towards disengaged positions, such as the positions shown in FIG. 8.

The die 720 includes a body 905 and an extension 910. The body 905 may be substantially disk-shaped except as described herein and depicted in FIG. 8. For example, the body 905 comprises a central aperture configured to slidably receive the support member 705 shown in FIG. 7. Several portions of the boundary, perimeter, surface or inner diameter of the central aperture are indicated by reference numeral 920 in FIG. 8. The body 905 may include one or more recesses 925 in the surface 920 defined by the central aperture. Each recess 925 may be sized and otherwise configured to receive and possibly retain an o-ring and/or other sealing element 930. Accordingly, fluid flow past the sealing element 930 between the body 905 and the support member 705 may be prevented. An upper, outside edge of the body 905 may comprise a chamfer 907 and/or otherwise be tapered or rounded.

The extension 910 may be substantially tubular, ring- or annulus-shaped, extending downward from the body 905. The extension 910 may be integrally formed with the body 905, such as by forging or machining from a single billet of metal round stock, or the extension 910 may be a discrete component coupled to the body 905 by welding, press-fitting, mechanical fasteners and/or other means. The extension 910 may have an aspect ratio (height:width) of at least about 2:1, and possibly as great as 10:1, 20:1 or more. The height or axial length of the extension 910 may be at least about 4 inches, and possibly as great as 20 feet or more. The outer surface or diameter 930 of the extension 910 may be substantially co-cylindrical with the inner surface or diameter 850 of the extension 810 of the anchor 715.

The die 720 also includes at least one internal brake 960 and at least one external brake 965. The internal and external brakes 960, 965 may each operate as a function of pressure, such as in response to the pressure within the pressure chamber 730 nearing, exceeding, or falling below a predetermined value. The internal brake 960 is configured to selectively engage the support member 705, such as by selectively exerting a radially inward force on the support member 705. The external brake 965 is configured to selectively engage the expandable tubular member 702, such as by selectively exerting a radially outward force on the expandable tubular member 702. The internal and external brakes 960, 965 may each comprise mechanical, hydraulic, magnetic and/or electrical means for selectively engaging the support member 702 and the expandable tubular member 702.

In an exemplary embodiment, the internal brake 960 includes a hydraulic piston 970 fluidicly coupled to the pressure chamber 730, such as via port 975, and the external brake 965 includes a hydraulic piston 980 fluidicly coupled to the pressure chamber 730, such as via port 985. An internal shoe or stop 990 is integral or coupled to the piston 970, and is configured to exert a radially inward force on the support member 705. An external shoe or stop 995 is integral or coupled to the piston 980, and is configured to exert a radially outward force on the expandable tubular member 702. Springs and/or other biasing means 997*a*, 997*b* may urge the shoes 990, 995 towards engaged positions, such as the positions shown in FIG. 8.

In operation, the internal and external brakes 860, 865 of the anchor 715 may have a default position when the pressure in the chamber 730 is a nominal pressure or is otherwise below a predetermined pressure level hereafter referred to as an expansion pressure. This default position may be a disengaged position in which the internal brake 860 does not engage the support member 705 and the external brake 865 does not engage the expandable tubular member 702 (such as the position depicted in FIG. 8). Moreover, when the pressure in the chamber 730 is below the expansion pressure, the internal and external brakes 960, 965 of the die 720 may have a default position (such as the position depicted in FIG. 8). This default position may be an engaged position in which the internal brake 960 engages the support member 705 and/or the external brake 965 engages the expandable tubular member 702 (such as the position depicted in FIG. 8).

As the pressure in the chamber 730 increases, the internal and external brakes 860, 865 of the anchor may move away from their disengaged positions and towards an engaged portion. That is, pressure in the chamber 730 may be increased by directing hydraulic fluid flow into the chamber 730, such as through an opening in the support member 705 fluidicly coupling the inside of the support member 705 with the chamber 730, among other means. The increased pressure operates to urge the piston 870 inward towards an engaged position, overcoming the outward force of the spring 897*a*. Similarly, the increased pressure operates to urge the piston 880 outward towards an engaged position, overcoming the inward force of the spring 897*b*. Simultaneously, the increased pressure operates to urge the piston 970 outward towards a disengaged position, overcoming the inward force of the spring 997*a*, and also operates to urge the piston 980 inward towards a disengaged position, overcoming the outward force of the spring 997*b*.

As the pressure in the chamber 730 continues to increase, the shoes 890, 895 engage the support member 705 and/or the expandable tubular member 702, and the shoes 990, 995 disengage the support member 705 and/or the expandable tubular member 702. With further increase in pressure, the size of the chamber 730 increases as the die 720 translates axially upward and away from the anchor 715.

Once the chamber 730 is expanded to a desired size by translating the die 720 away from the anchor 715, depressurization of the chamber 730 may be initiated, such as by allowing hydraulic fluid to flow out of the chamber 730, possibly into the support member 705. As the pressure in the chamber 730 decreases toward and below the expansion pressure, the piston 870 is again urged outward towards a disengaged position as the outward force of the spring 897*a* overcomes the inward force of pressure acting on the piston 870. Similarly, the piston 880 is again urged inward towards a disengaged position as the inward force of the spring 897*b* overcomes the outward force of pressure acting on the piston 880. Simultaneously, the decreased pressure allows the piston 970 to again be urged inward towards an engaged position as the inward force of the spring 997*a* overcomes the outward force of pressure acting on the piston 970, and also allows the piston 980 to again be urged outward towards an engaged position as the outward force of the spring 997*b* overcomes the inward force of pressure acting on the piston 980.

Consequently, as the pressure in the chamber 730 continues to decrease, the shoes 890, 895 disengage the support member 705 and/or the expandable tubular member 702, and the shoes 990, 995 engage the support member 705 and/or the expandable tubular member 702. With further decrease in pressure, the size of the chamber 730 decreases as the anchor 715 translates axially upward and towards the die 720 in response to the tensile force of the biasing means 735. This process may be repeated any number of times to expand incremental portions of the expandable tubular member 702, as described below with reference to FIGS. 9-22.

Figure 9:
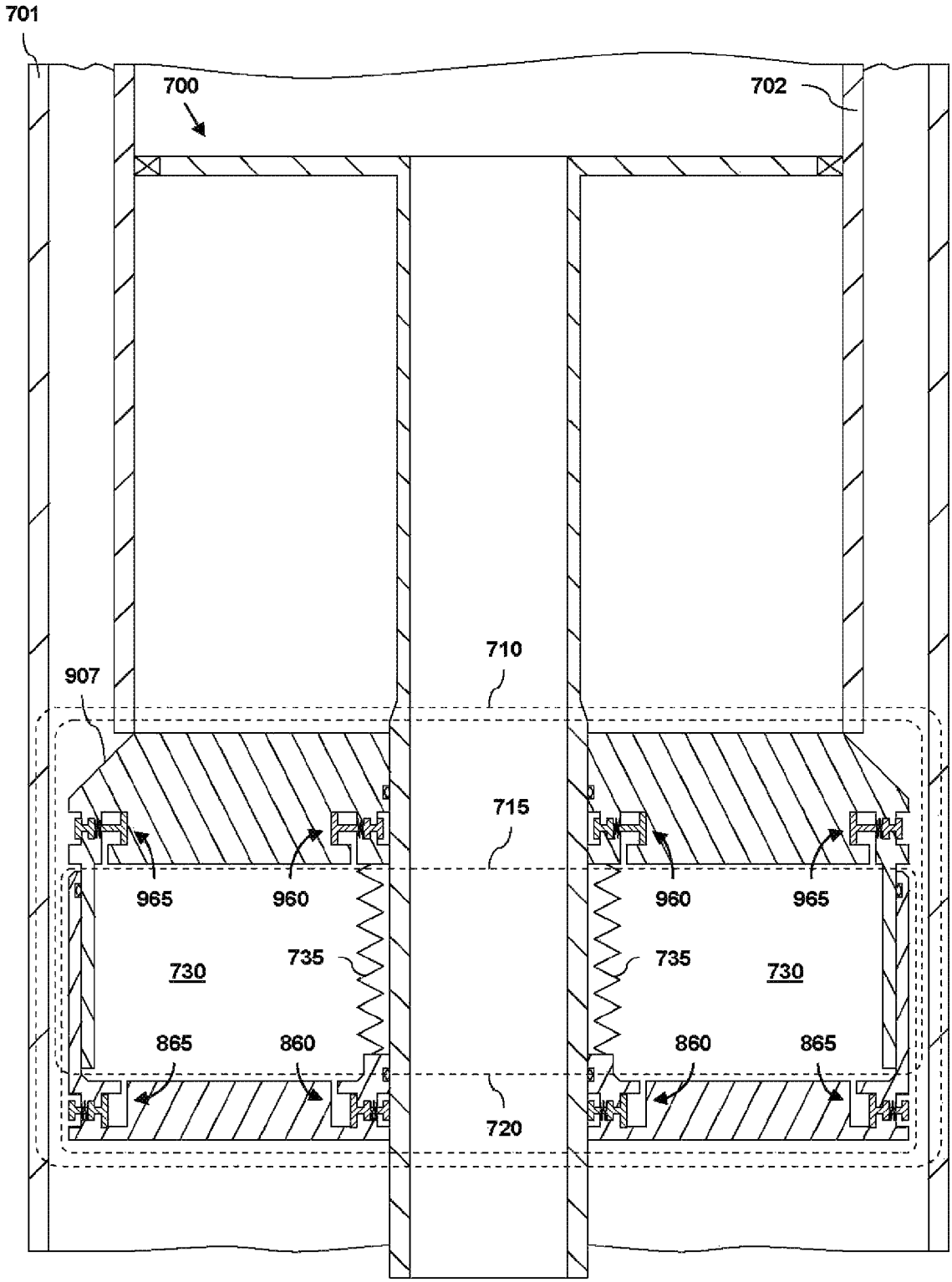
FIG. 9 is a fragmentary cross-sectional illustration of the apparatus of FIG. 7 in an initial or intermediate stage of a tubular member expansion method according to one or more aspects of the present disclosure.

Referring to FIG. 9, illustrated is a sectional view of the apparatus 700 shown in FIGS. 7 and 8 in an initial or intermediate stage of operation. The pressure inside the chamber 730 of the expansion device 710 is just below the expansion pressure, such that the expansion device 710 remains collapsed yet the internal brakes 860 of the anchor 715 are engaged with the thicker portion 705*aa* of the support member 705 and the internal brakes 960 of the die 720 are disengaged from the support member 705. The expandable tubular member 702 is in a pre-expanded state and is positioned at or near the chamfer 907 of the die 720.

Figure 10:
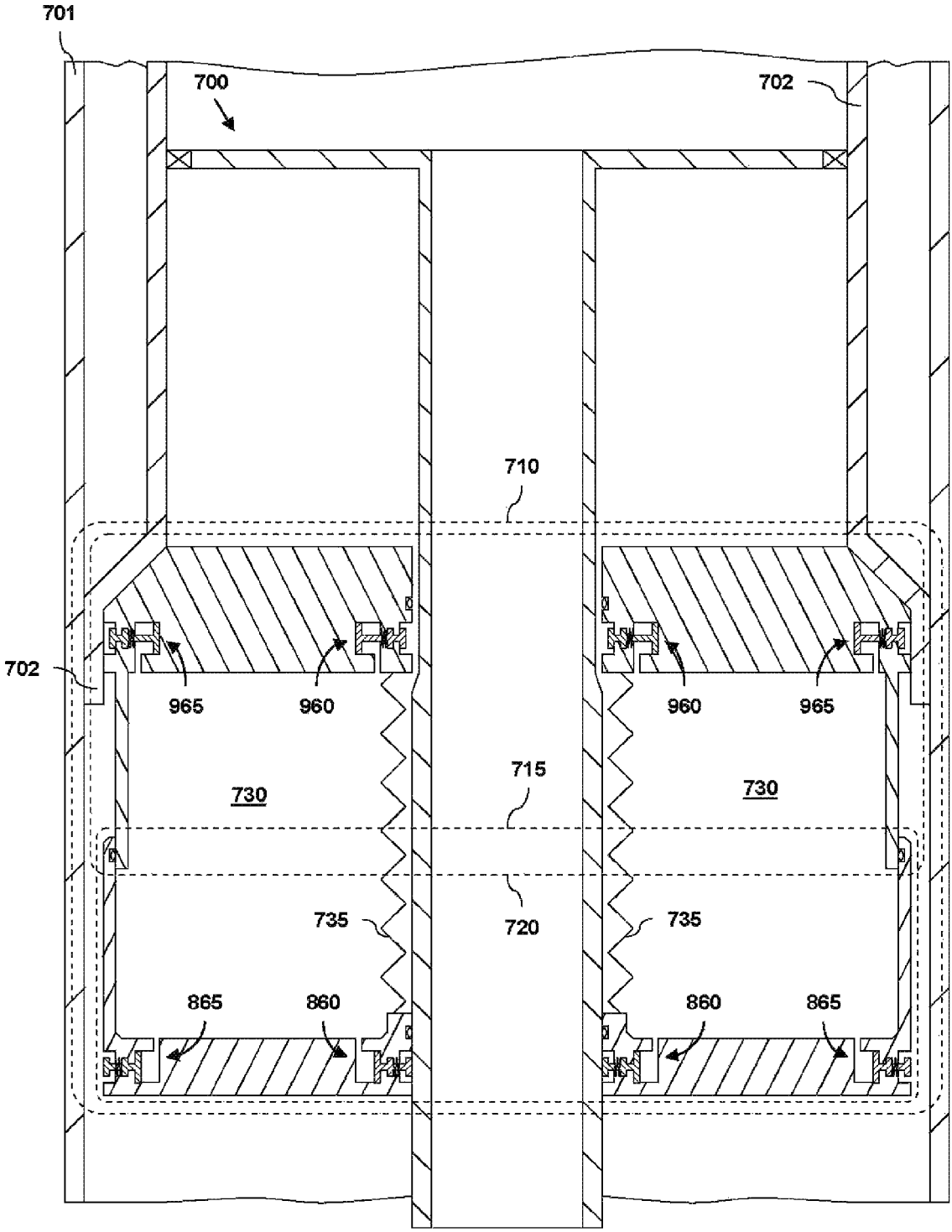
FIG. 10 is a fragmentary cross-sectional illustration of the apparatus of FIG. 9 in a subsequent stage of the tubular member expansion method according to one or more aspects of the present disclosure.

Referring to FIG. 10, illustrated is a sectional view of the apparatus 700 shown in FIG. 9 in a subsequent stage of operation. The pressure inside the chamber 730 of the expansion device 710 has been increased beyond the expansion pressure, such that the expansion device 710 has expanded while the internal brakes 860 of the anchor 715 remain engaged with the thicker portion 705*aa* of the support member 705 and the internal brakes 960 of the die 720 remain disengaged from the support member 705. As a result of the expansion of the expansion device 710, the die 720 has been forced into the end of the expandable tubular member 702, thereby radially expanding and plastically deforming a portion 702*b* of the expandable tubular member 702 to a diameter at least as large as the outer diameter of the die 720. The expansion of the expansion device 710 includes the axial translation of the die 720 along the support member 705 a distance sufficient for the internal brakes 960 of the die 720 to travel past the thicker portion 705*aa* of the support member 705 and for the external brakes 965 of the die 720 to travel into the expanded portion 702*b* of the expandable tubular member 702.

Figure 11:
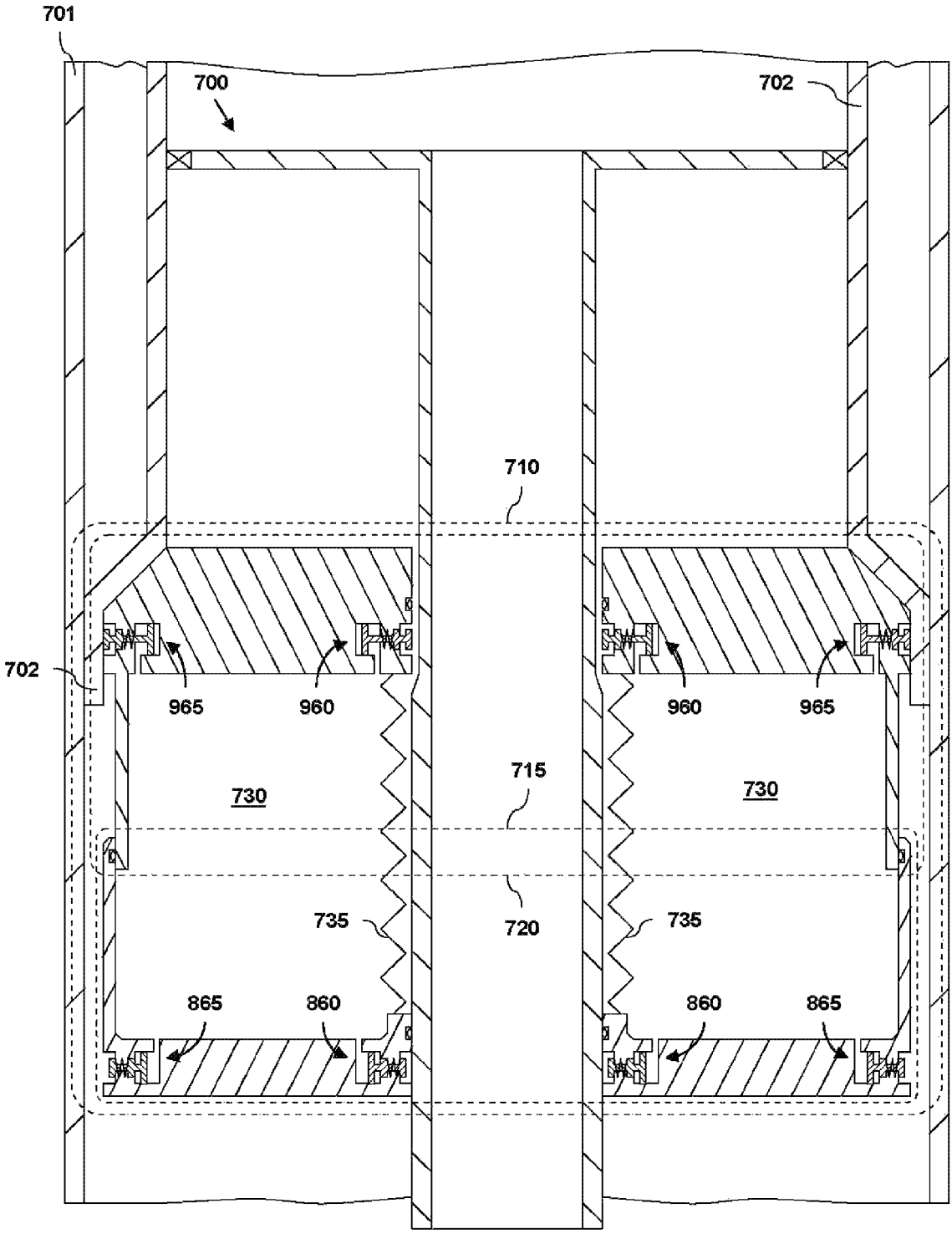
FIG. 11 is a fragmentary cross-sectional illustration of the apparatus of FIG. 10 in a subsequent stage of the tubular member expansion method according to one or more aspects of the present disclosure.

Referring to FIG. 11, illustrated is a sectional view of the apparatus 700 shown in FIG. 10 in a subsequent stage of operation. The pressure inside the chamber 730 of the expansion device 710 has been decreased to just below the expansion pressure, such that the external brakes 965 of the die 720 have engaged the internal surface of the expanded portion 702*b* of the expandable tubular member 702, and such that the internal brakes 860 of the anchor 715 have disengaged from the thicker portion 705*aa* of the support member 705.

Figure 12:
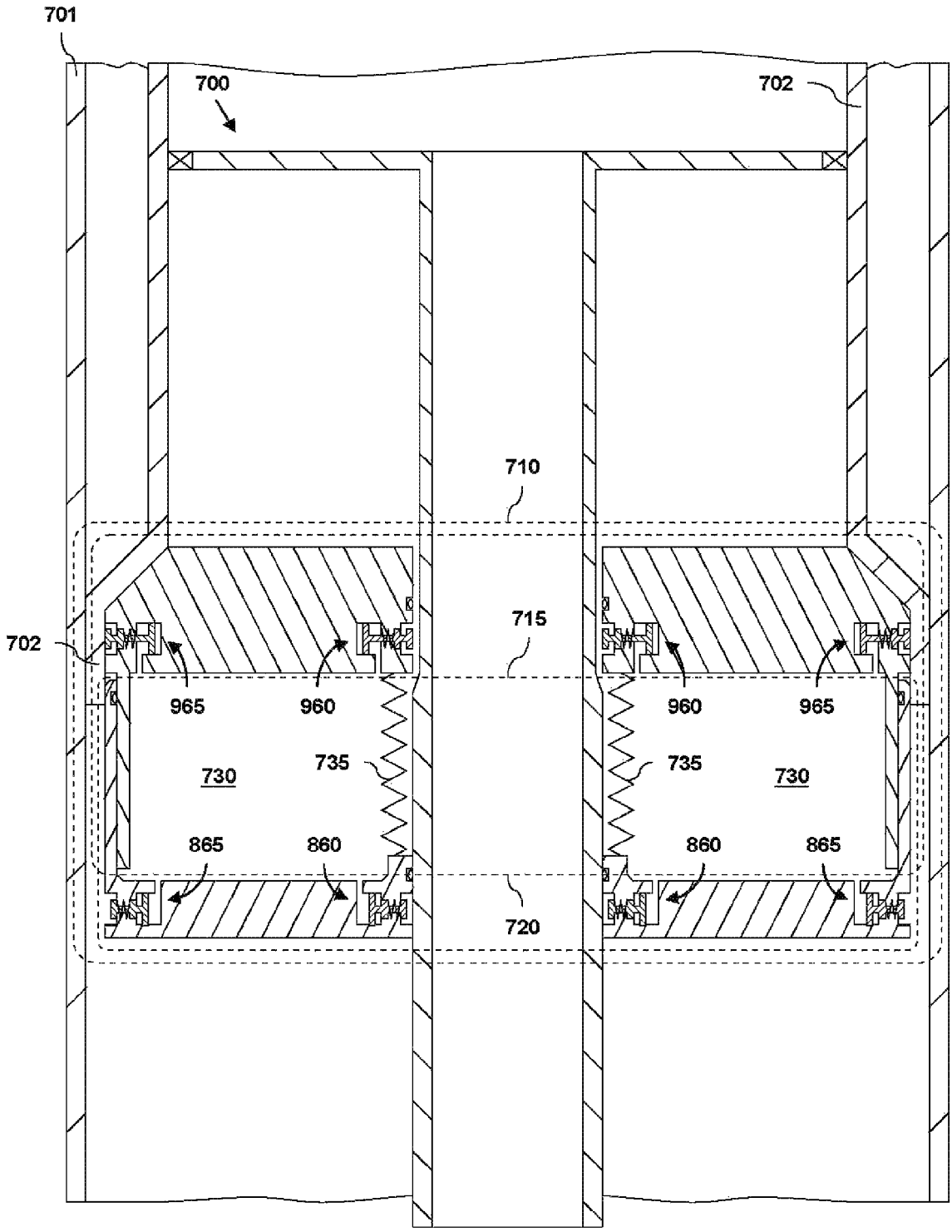
FIG. 12 is a fragmentary cross-sectional illustration of the apparatus of FIG. 11 in a subsequent stage of the tubular member expansion method according to one or more aspects of the present disclosure.

Referring to FIG. 12, illustrated is a sectional view of the apparatus 700 shown in FIG. 11 in a subsequent stage of operation. As the pressure inside the chamber 730 of the expansion device 710 continues to decrease further below the expansion pressure, the biasing means 735 begin to overcome the pressure inside the chamber 730 and draw the anchor 715 upwards towards the die 720, possibly ultimately to the collapsed configuration shown in FIG. 12.

Figure 13:
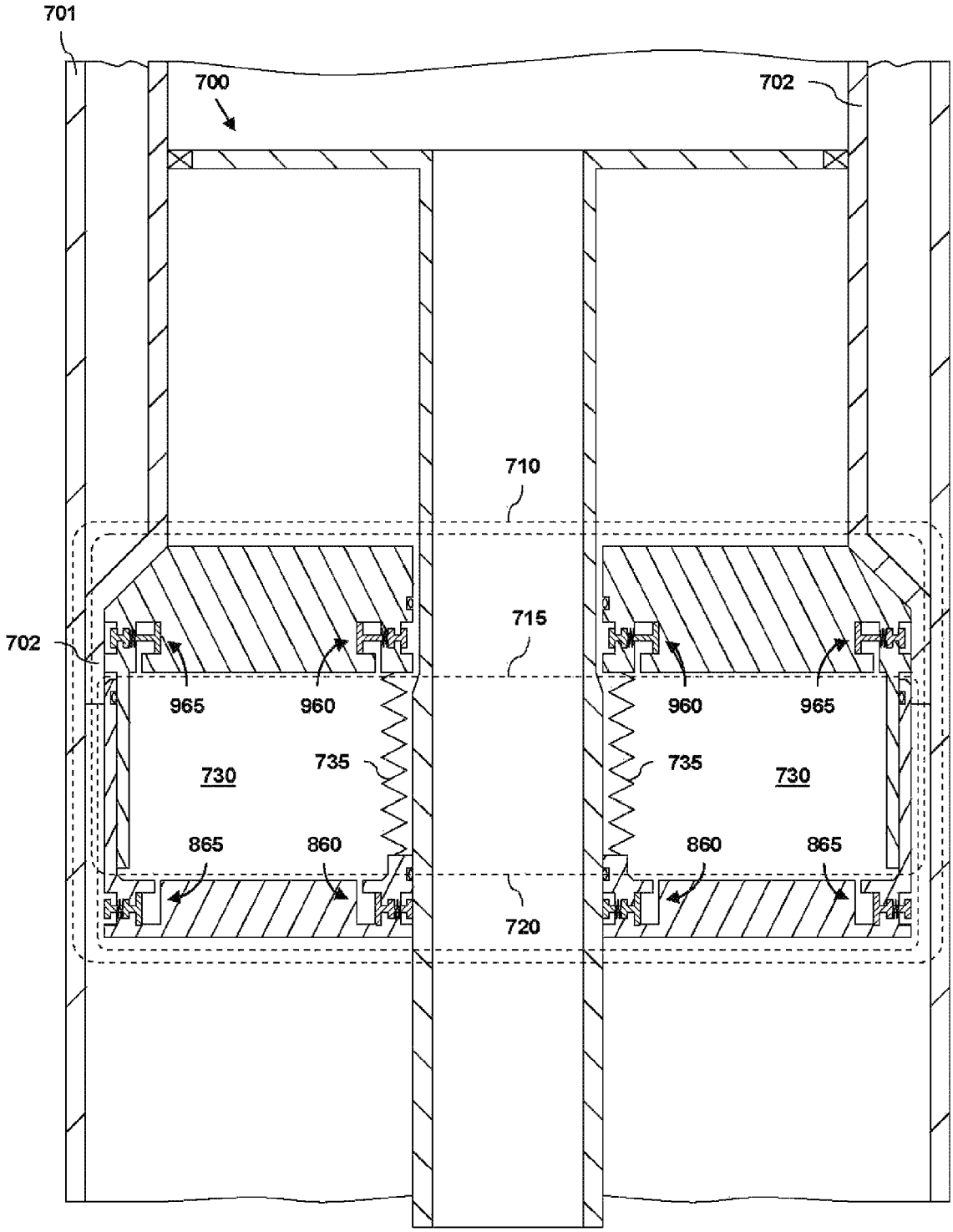
FIG. 13 is a fragmentary cross-sectional illustration of the apparatus of FIG. 12 in a subsequent stage of the tubular member expansion method according to one or more aspects of the present disclosure.

Referring to FIG. 13, illustrated is a sectional view of the apparatus 700 shown in FIG. 12 in a subsequent stage of operation. The pressure inside the chamber 730 of the expansion device 710 has been increased to just below the expansion pressure, such that the expansion device 710 remains collapsed yet the internal brakes 860 of the anchor 715 once again engage the thicker portion 705*aa* of the support member 705 and the external brakes 965 of the die 720 disengage from the expanded portion 702*b* of the expandable tubular member 702.

Figure 14:
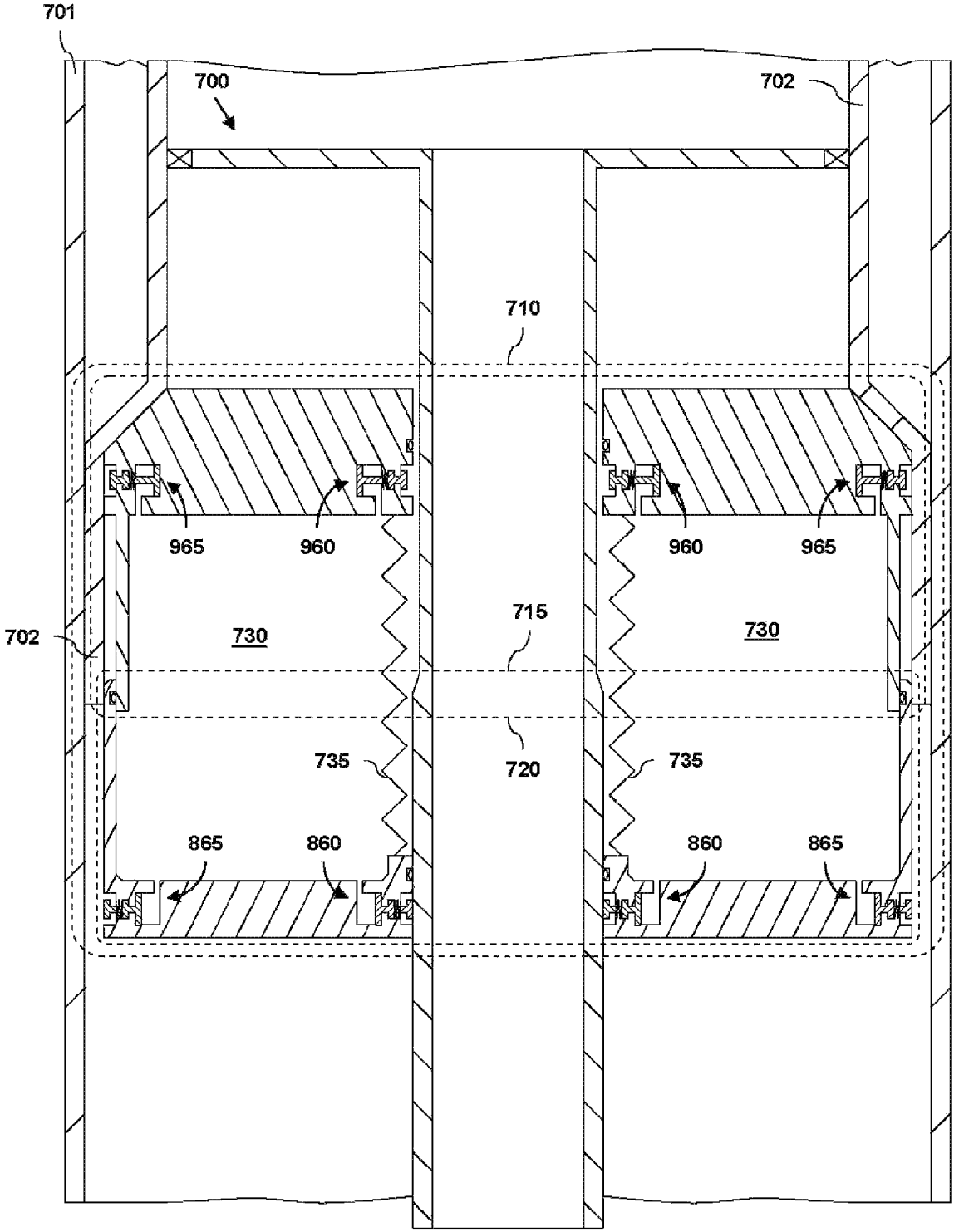
FIG. 14 is a fragmentary cross-sectional illustration of the apparatus of FIG. 13 in a subsequent stage of the tubular member expansion method according to one or more aspects of the present disclosure.

Referring to FIG. 14, illustrated is a sectional view of the apparatus 700 shown in FIG. 13 in a subsequent stage of operation. The pressure inside the chamber 730 of the expansion device 710 has been increased beyond the expansion pressure, such that the expansion device 710 has expanded while the internal brakes 860 of the anchor 715 remain engaged with the thicker portion 705*aa* of the support member 705 and the external brakes 965 of the die 720 remain disengaged from the expanded portion 702*b* of the expandable tubular member 702. As a result of the expansion of the expansion device 710, the die 720 has been forced further into the expandable tubular member 702, thereby increasing the portion 702*b* of the expandable tubular member 702 that has been radially expanded and plastically deformed. The lower end of the expanded portion 702*b* also now interposes the outer diameter of the anchor 715 and the wellbore or casing 701.

Figure 15:
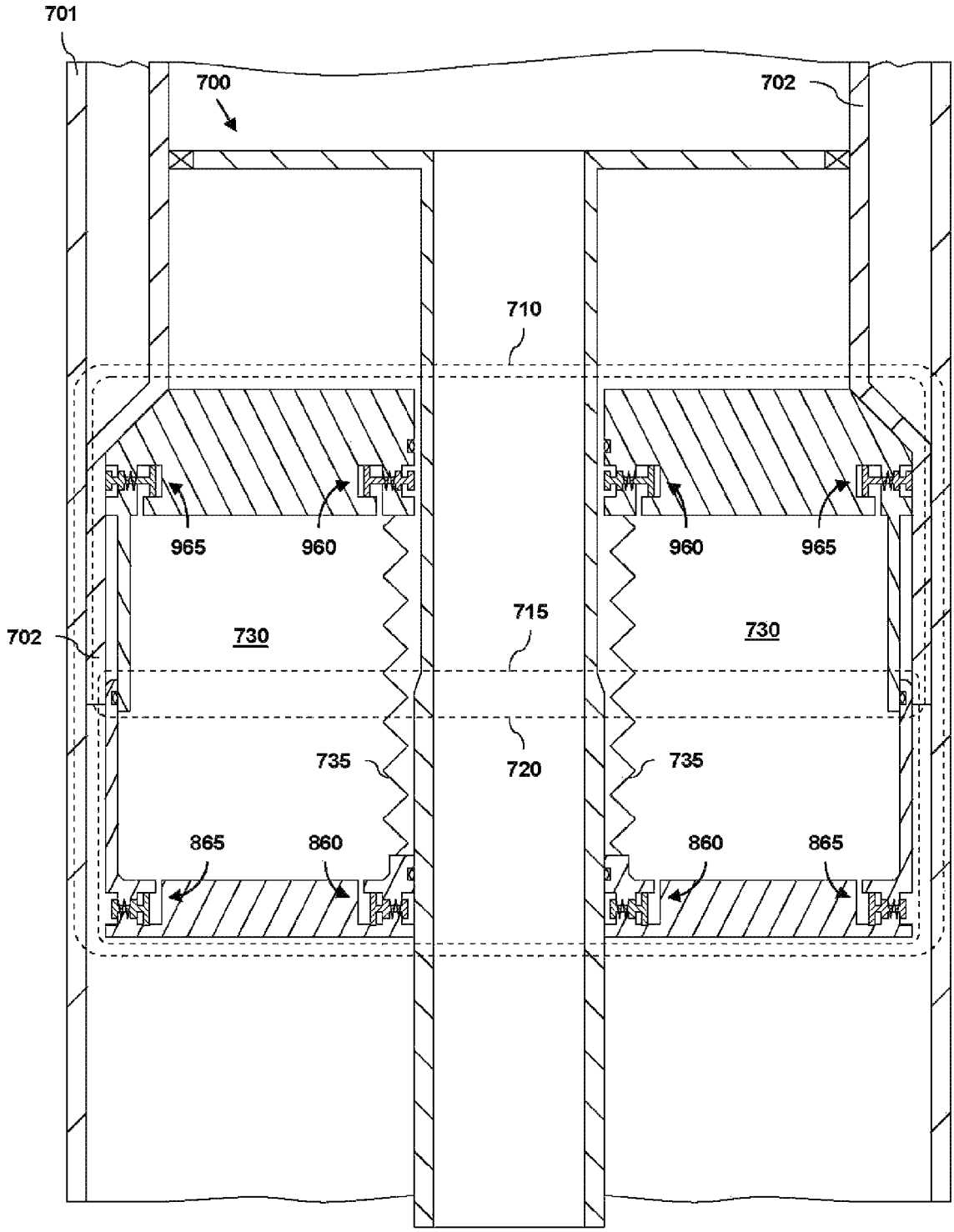
FIG. 15 is a fragmentary cross-sectional illustration of the apparatus of FIG. 14 in a subsequent stage of the tubular member expansion method according to one or more aspects of the present disclosure.

Referring to FIG. 15, illustrated is a sectional view of the apparatus 700 shown in FIG. 14 in a subsequent stage of operation. The pressure inside the chamber 730 of the expansion device 710 has been decreased to just below the expansion pressure, such that the external brakes 965 of the die 720 have once again engaged the internal surface of the expanded portion 702*b* of the expandable tubular member 702, and such that the internal brakes 860 of the anchor 715 have disengaged from the thicker portion 705*aa* of the support member 705.

Figure 16:
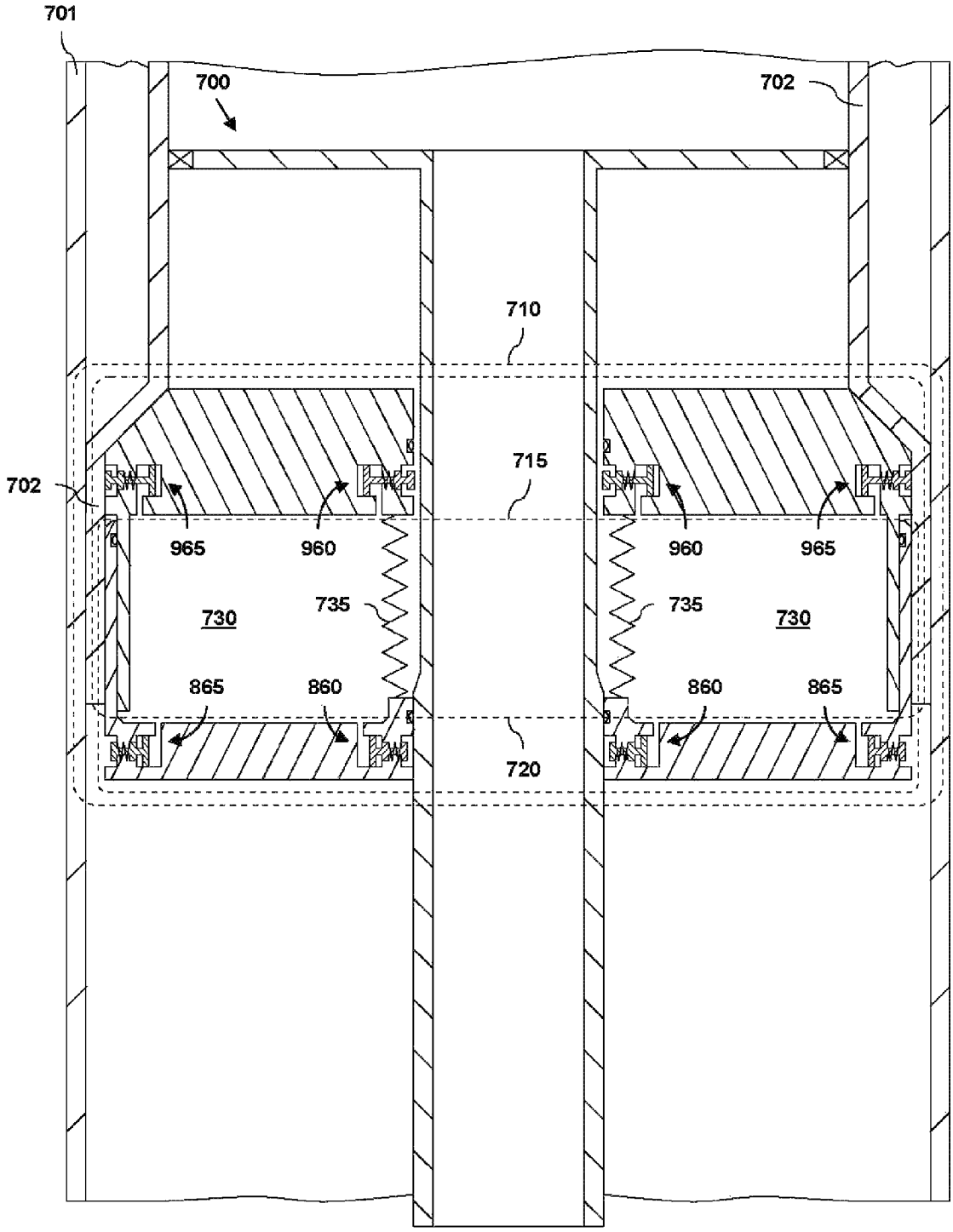
FIG. 16 is a fragmentary cross-sectional illustration of the apparatus of FIG. 15 in a subsequent stage of the tubular member expansion method according to one or more aspects of the present disclosure.

Referring to FIG. 16, illustrated is a sectional view of the apparatus 700 shown in FIG. 15 in a subsequent stage of operation. As the pressure inside the chamber 730 of the expansion device 710 continues to decrease further below the expansion pressure, the biasing means 735 begin to overcome the pressure inside the chamber 730 and draw the anchor 715 upwards towards the die 720, possibly ultimately to the collapsed configuration shown in FIG. 16.

Figure 17:
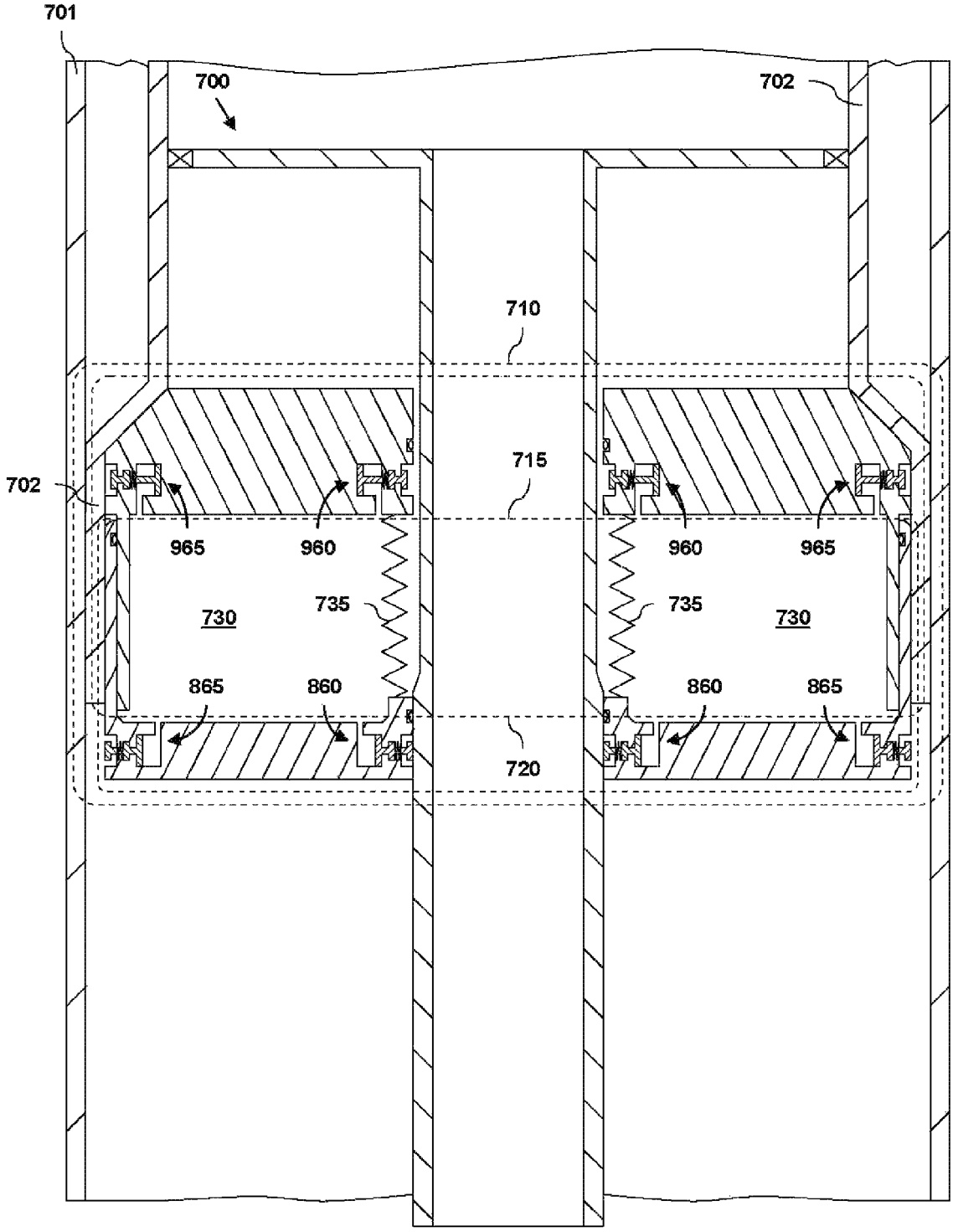
FIG. 17 is a fragmentary cross-sectional illustration of the apparatus of FIG. 16 in a subsequent stage of the tubular member expansion method according to one or more aspects of the present disclosure.

Referring to FIG. 17, illustrated is a sectional view of the apparatus 700 shown in FIG. 16 in a subsequent stage of operation. The pressure inside the chamber 730 of the expansion device 710 has been increased to just below the expansion pressure, such that the expansion device 710 remains collapsed yet the internal brakes 860 of the anchor 715 once again engage the thicker portion 705*aa* of the support member 705 and the external brakes 965 of the die 720 disengage from the expanded portion 702*b* of the expandable tubular member 702.

Figure 18:
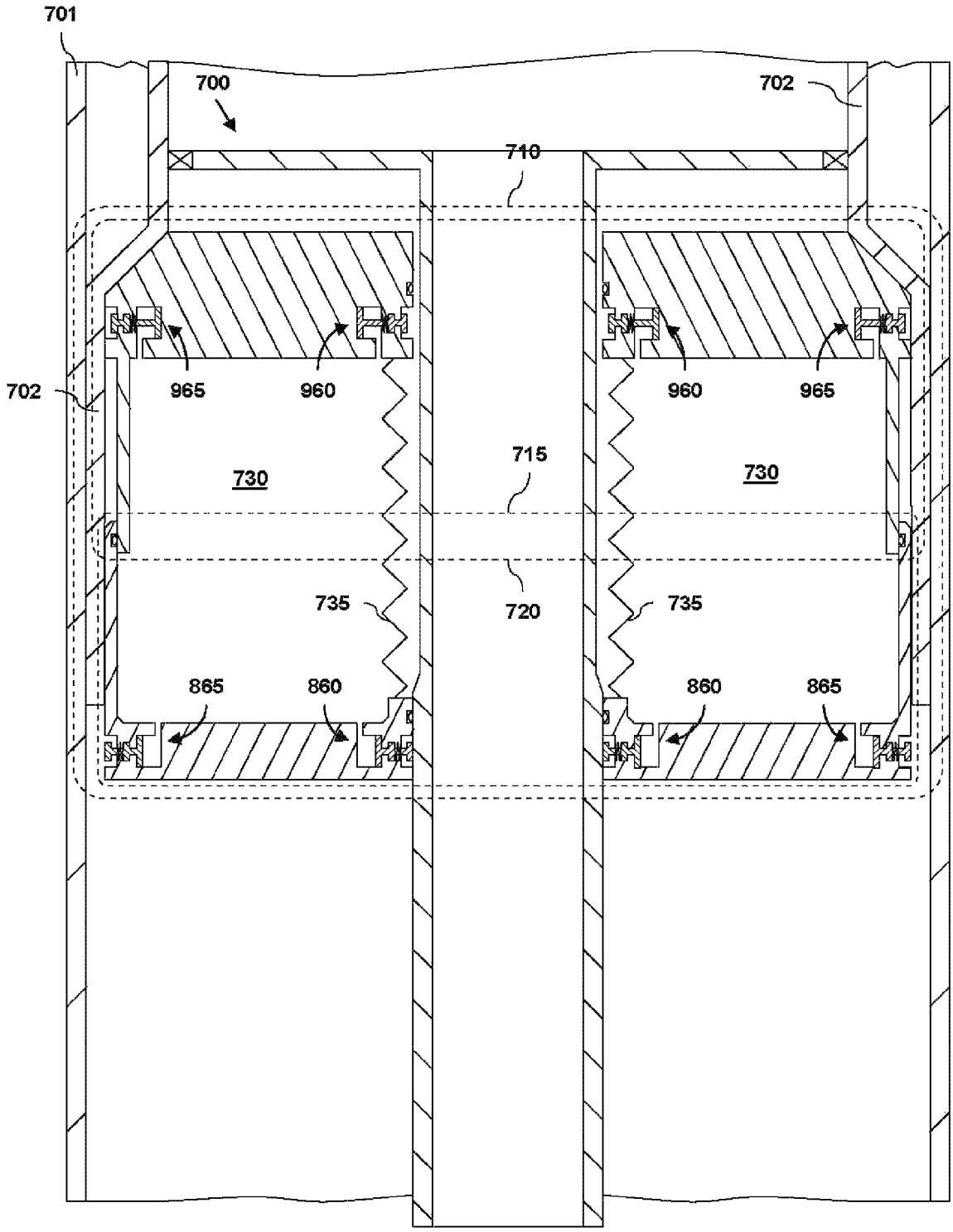
FIG. 18 is a fragmentary cross-sectional illustration of the apparatus of FIG. 17 in a subsequent stage of the tubular member expansion method according to one or more aspects of the present disclosure.

Referring to FIG. 18, illustrated is a sectional view of the apparatus 700 shown in FIG. 17 in a subsequent stage of operation. The pressure inside the chamber 730 of the expansion device 710 has been increased beyond the expansion pressure, such that the expansion device 710 has expanded while the internal brakes 860 of the anchor 715 remain engaged with the thicker portion 705*aa* of the support member 705 and the external brakes 965 of the die 720 remain disengaged from the expanded portion 702*b* of the expandable tubular member 702. As a result of the expansion of the expansion device 710, the die 720 has been forced further into the expandable tubular member 702, thereby increasing the portion 702*b* of the expandable tubular member 702 that has been radially expanded and plastically deformed.

Figure 19:
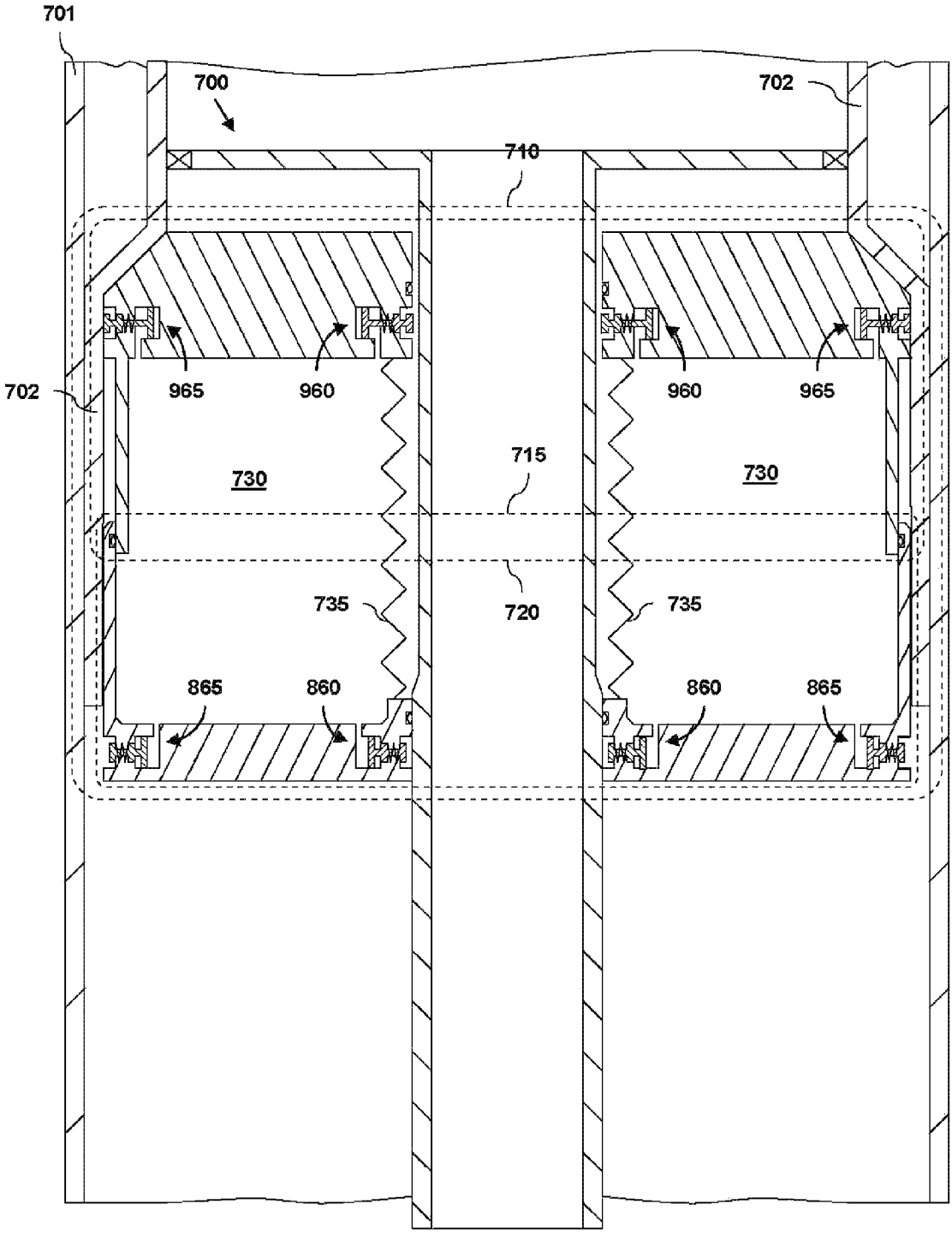
FIG. 19 is a fragmentary cross-sectional illustration of the apparatus of FIG. 18 in a subsequent stage of the tubular member expansion method according to one or more aspects of the present disclosure.

Referring to FIG. 19, illustrated is a sectional view of the apparatus 700 shown in FIG. 18 in a subsequent stage of operation. The pressure inside the chamber 730 of the expansion device 710 has been decreased to just below the expansion pressure, such that the external brakes 965 of the die 720 have once again engaged the internal surface of the expanded portion 702*b* of the expandable tubular member 702, and such that the internal brakes 860 of the anchor 715 have disengaged from the thicker portion 705*aa* of the support member 705.

Figure 20:
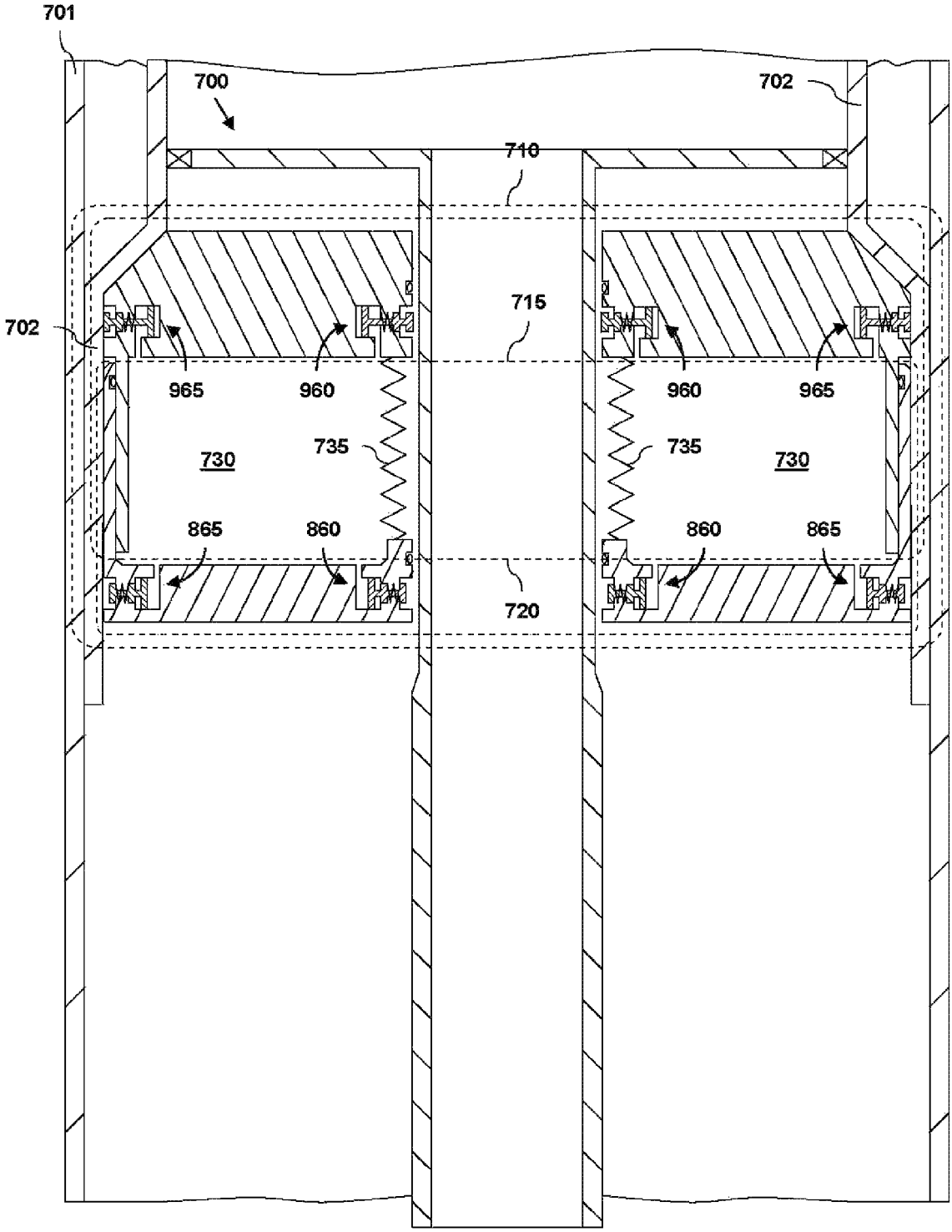
FIG. 20 is a fragmentary cross-sectional illustration of the apparatus of FIG. 19 in a subsequent stage of the tubular member expansion method according to one or more aspects of the present disclosure.

Referring to FIG. 20, illustrated is a sectional view of the apparatus 700 shown in FIG. 19 in a subsequent stage of operation. As the pressure inside the chamber 730 of the expansion device 710 continues to decrease further below the expansion pressure, the biasing means 735 begin to overcome the pressure inside the chamber 730 and draw the anchor 715 upwards towards the die 720, possibly ultimately to the collapsed configuration shown in FIG. 20. The expanded portion 702*b* of the expandable tubular member 702 now extends between the outer brakes 865 of the anchor 715 and the wellbore or casing 701. Also, the contraction of the expansion device 710 includes the axial translation of the anchor 715 along the support member 705 a distance sufficient for the internal brakes 860 of the anchor 715 to travel upward past the thicker portion 705*aa* of the support member 705, and for the external brakes 865 of the anchor 715 to travel into the end of the expanded portion 702*b* of the expandable tubular member

702 such that the expanded portion 702*b* of the expandable tubular member 702 interposes the external brakes 865 of the anchor 715 and the wellbore or casing 701.

Figure 21:
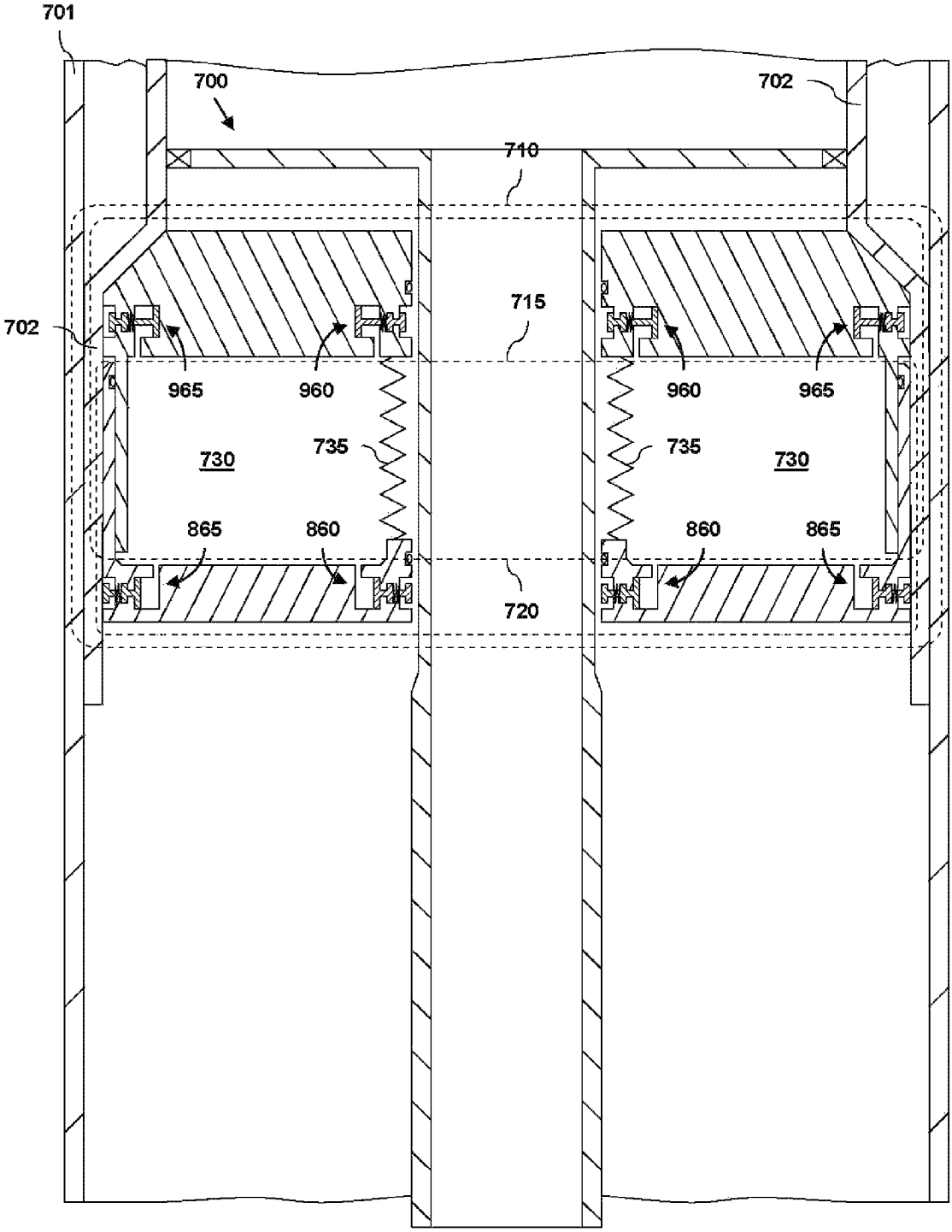
FIG. 21 is a fragmentary cross-sectional illustration of the apparatus of FIG. 20 in a subsequent stage of the tubular member expansion method according to one or more aspects of the present disclosure.

Referring to FIG. 21, illustrated is a sectional view of the apparatus 700 shown in FIG. 20 in a subsequent stage of operation. The pressure inside the chamber 730 of the expansion device 710 has been increased to just below the expansion pressure, such that the expansion device 710 remains collapsed yet the external brakes 865 of the anchor 715 engage the expanded portion 702*b* of the expandable tubular member 702 and the external brakes 965 of the die 720 disengage from the expanded portion 702*b* of the expandable tubular member 702.

Figure 22:
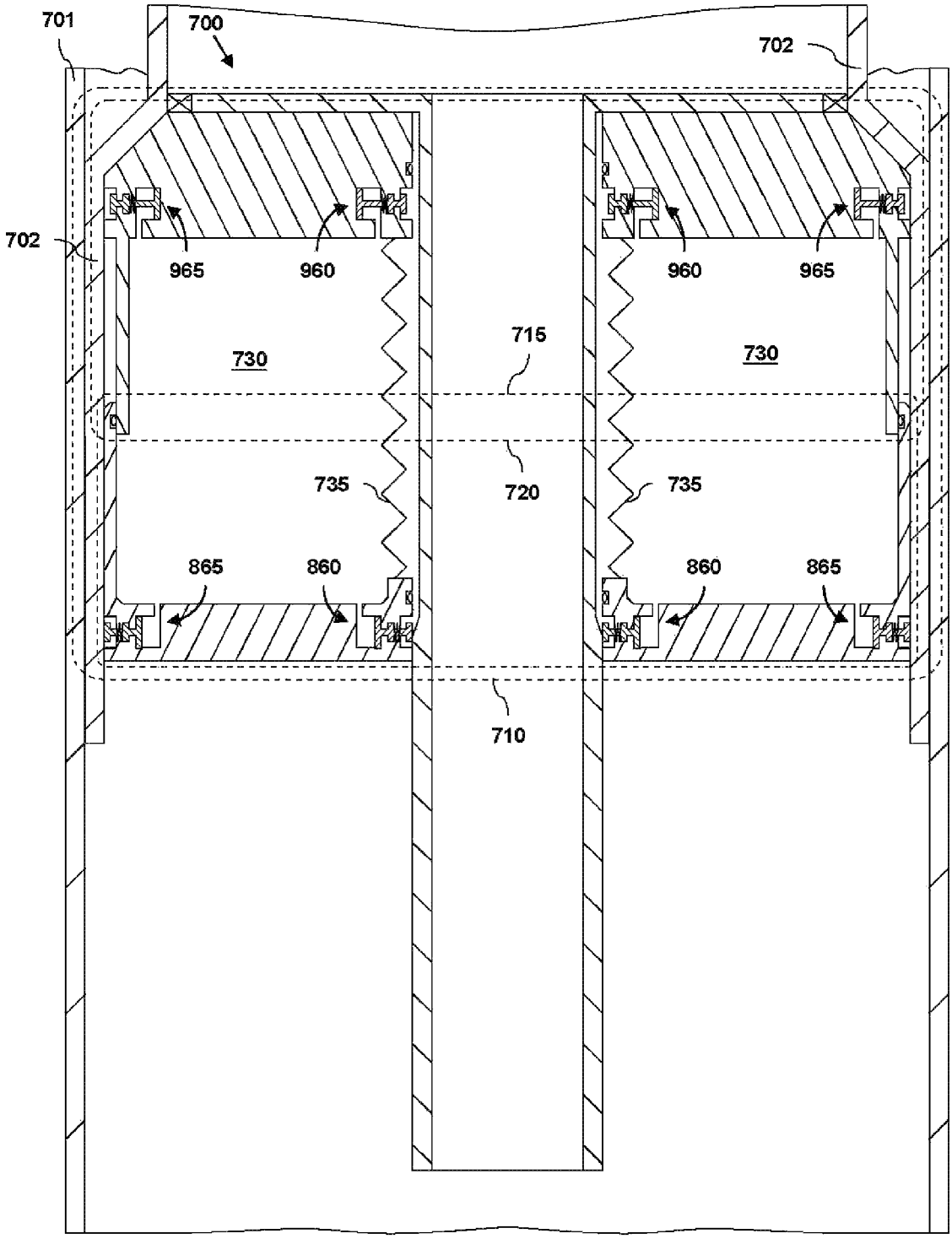
FIG. 22 is a fragmentary cross-sectional illustration of the apparatus of FIG. 21 in a subsequent stage of the tubular member expansion method according to one or more aspects of the present disclosure.

Referring to FIG. 22, illustrated is a sectional view of the apparatus 700 shown in FIG. 21 in a subsequent stage of operation. The pressure inside the chamber 730 of the expansion device 710 has been increased beyond the expansion pressure, such that the expansion device 710 has expanded while the external brakes 865 of the anchor 715 remain engaged with the expanded portion 702*b* of the expandable tubular member 702 and the external brakes 965 of the die 720 remain disengaged from the expanded portion 702*b* of the expandable tubular member 702. As a result of the expansion of the expansion device 710, the die 720 has been forced further into the expandable tubular member 702, thereby increasing the portion 702*b* of the expandable tubular member 702 that has been radially expanded and plastically deformed.

The incremental or "inchworm" process shown in FIGS. 9-22 may be continued until the desired length of the expandable tubular member 702 has been radially expanded and plastically deformed. In an exemplary embodiment, the detachable coupling means 725 may be configured to allow the support member 705 to ride upwards resting on the expansion device 710. Thereafter, the support member 705 may be removed by any of myriad means. Alternatively, the support member 705 may be removed once the expansion device 710 has traveled past the thicker portion 705*aa* of the support member 705.

In an exemplary embodiment, the incremental process depicted in FIGS. 9-22 may be employed as a method of radially expanding the expandable tubular member 702 with the expansion device 710 having a base 715 that is movable relative to the expandable tubular member 702, a former 720 that is movable relative to the expandable tubular member 702 and the base 715, and a pressure chamber 730 interposing the base 715 and the former 720. Such a method may comprise sensing a first pressure within the pressure chamber 730 via each of a first pressure sensing element of the base 715 and a second pressure sensing element of the former 720. For example, the first pressure sensing element may comprise or be associated with the piston 870/spring 897*a* configuration and/or the piston 870/spring 897*b* configuration shown in FIG. 8, and the second pressure sensing element may comprise or be associated with the piston 970/spring 997*a* configuration and/or the piston 980/spring 997*b* configuration shown in FIG. 8. The method may further comprise positionally fixing the base 715 relative to the expandable tubular member 702 in response to the first pressure sensing element of the base 715 sensing that the first pressure in the pressure chamber 730 exceeds a first predetermined pressure. The method may further comprise positionally releasing the former 720 relative to the expandable tubular member 702 in response to the second pressure sensing element of the former 720 sensing that the first pressure exceeds the first predetermined pressure. The method may further comprise sensing a second pressure within the pressure chamber 730 via a third pressure sensing element of at least one of the base 715 and the former 720. For example, the third pressure sensing element may comprise or be associated with the biasing means 735 shown in FIG. 8. The method may further comprise displacing the former 720 away from the base 715 and through the expandable tubular member 702 in response to the third pressure sensing element sensing that the second pressure exceeds a second predetermined pressure.

Figure 23:
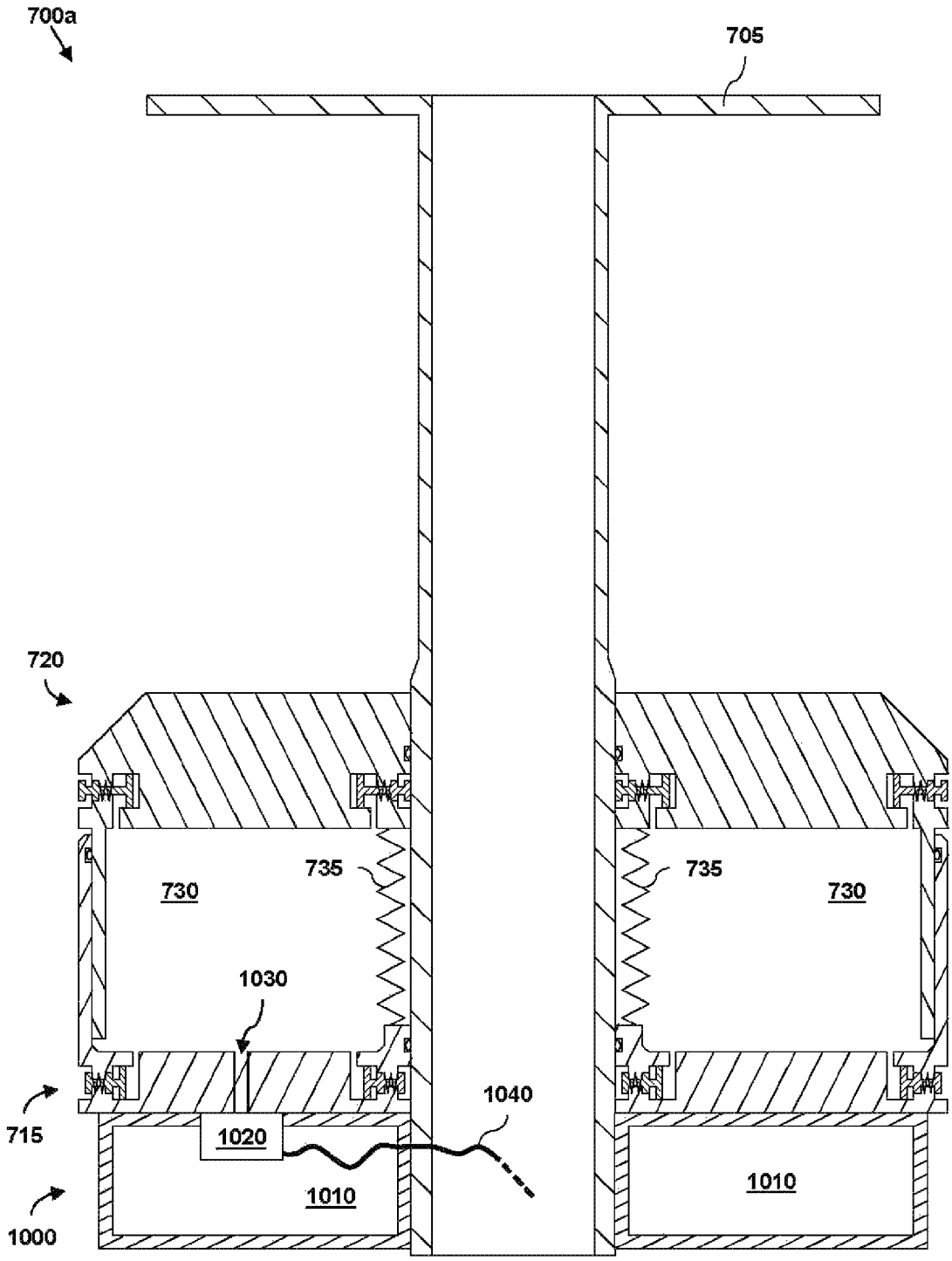

Referring to FIG. 23, illustrated is a sectional view of an embodiment of the apparatus 700 shown in FIGS. 7-22, herein designated by reference numeral 700*a*. The apparatus 700*a* is substantially identical to the apparatus 700 shown in FIGS. 7-22. However, the apparatus 700*a* is depicted as further comprising a hydraulic system 1000 coupled to the base 715. Of course, in an exemplary embodiment, the apparatus 700 shown in FIGS. 7-22 also includes the hydraulic system 1000 shown in FIG. 23. Nonetheless, for the sake of clarity, and because the hydraulic system 1000 is but one example of means for operating the apparatus 700 shown in FIGS. 7-22, the hydraulic system 1000 is not shown in FIGS. 7-22.

The hydraulic system 1000 comprises a hydraulic reservoir 1010 and a hydraulic pump 1020. The hydraulic reservoir 1010 is an annulus shaped reservoir extending around the support member 705 and configured to contain hydraulic fluid, possibly under pressure. The hydraulic reservoir 1010 is coupled to the base 715, whether directly or indirectly, by threaded or other mechanical fasteners, welding and/or other coupling means.

The hydraulic pump 1020 is fluidicly coupled between the hydraulic reservoir 1010 and a passage 1030 leading to the pressure chamber 730. The hydraulic pump 1020, which may be a conventional or future-developed pump, is configured to transmit hydraulic fluid from the hydraulic reservoir 1010 to the pressure chamber 730 via the passage 1030 to pressurize the pressure chamber 730 and thereby provide the expansion force necessary to overcome the biasing means 735 and transition the former 720 away from the base 715. The hydraulic pump 1020 is also configured to transmit hydraulic fluid from the pressure chamber 730 via the passage 1030 to the hydraulic reservoir 1010 to depressurize the pressure chamber 730 and thereby allow the biasing means 735 to draw the base 715 and the former 720 back together. In an alternative embodiment, the hydraulic pump 1020 may comprise, or be replaced by, two or more separate pumps, including one or more pumps for transmitting hydraulic fluid from the hydraulic reservoir 1010 to the pressure chamber 730, and another one or more pumps for transmitting hydraulic fluid from the pressure chamber 730 to the hydraulic reservoir 1010.

The hydraulic system 1000 may be remotely operated, whether wirelessly or via an electronic or hydraulic communication umbilical 1040 extending away from the hydraulic pump 1020 and/or other component of the hydraulic system 1000 to a controller and/or operator located remote from the apparatus 700. For example, in an exemplary embodiment in which the apparatus 700 is utilized to install or repair a section of a wellbore casing, the communication umbilical 1040 may extend up the borehole to a control module or operator located at the surface. In another exemplary embodiment, in which the apparatus 700 is utilized to repair a section of a pipeline, the communication umbilical 1040 may extend inside the pipeline to an opening in the pipeline where repair personnel are positioned to remotely operate the apparatus 700. Consequently, the apparatus 700 may be remotely operated from a distance of several thousand feet, or more. The communication umbilical 1040 may extend through a portion of the hydraulic reservoir 1010, as shown in FIG. 23, or along the outside of the hydraulic reservoir 1010, or otherwise.

It is understood that variations may be made in the foregoing without departing from the scope of the invention. For example, the apparatus 100 and/or the apparatus 700 may be used to form and/or repair, for example, a wellbore casing, a pipeline, or a structural support. Furthermore, the burst discs 115*ea* and 115*fa* of the apparatus 100 may be replaced with conventional pressure relief valves.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. A method of radially expanding a tubular member, comprising:

coupling an expansion assembly to the tubular member, wherein the expansion assembly comprises a support member, an anchor and a die, wherein the support member extends through the anchor and the die, and wherein the support member is coupled to the tubular member;

restricting movement of the anchor relative to the tubular and support members while displacing the die through the tubular member to radially expand the tubular member; and restricting movement of the die relative to the tubular and support members while displacing the anchor through the tubular member, wherein the anchor comprises a first brake configured to selectively engage the support member, and wherein coupling the expansion assembly to the support member comprises engaging the support member with the first brake.

2. The method of claim 1 wherein the anchor comprises a second brake configured to selectively engage the tubular member, and wherein restricting movement of the anchor relative to the support member comprises at least one of:

engaging the support member with the first brake; and engaging the tubular member with the second brake.

3. The method of claim 2 wherein displacing the anchor through the tubular member comprises disengaging the first brake from the support member and disengaging the second brake from the tubular member.

4. The method of claim 1 wherein the expansion assembly comprises a pressure chamber defined by internal surfaces of the anchor and the die and an external surface of the support member, wherein displacing the anchor through the tubular member comprises pressurizing the pressure chamber, and wherein displacing the anchor through the tubular member comprises depressurizing the pressure chamber.

5. The method of claim 4 wherein the expansion assembly comprises a reservoir coupled to the anchor and a pump fluidicly coupled between the reservoir and the pressure chamber, wherein pressurizing the pressure chamber comprises operating the pump to transmit hydraulic fluid from the reservoir to the pressure chamber, and wherein depressurizing the pressure chamber comprises operating the pump to transmit hydraulic fluid from the pressure chamber to the reservoir.

6. A method of radially expanding a tubular member, comprising:

coupling an expansion assembly to the tubular member, wherein the expansion assembly comprises a support member, an anchor and a die, wherein the support member extends through the anchor and the die, and wherein the support member is coupled to the tubular member;

restricting movement of the anchor relative to the tubular and support members while displacing the die through the tubular member to radially expand the tubular member; and restricting movement of the die relative to the tubular and support members while displacing the anchor through the tubular member, wherein the die comprises a first brake configured to selectively engage the support member and a second brake configured to selectively engage the tubular member, and wherein displacing the die through the tubular member comprises disengaging the first brake from the support member and disengaging the second brake from the tubular member.

7. The method of claim 6 wherein restricting movement of the die relative to the support member comprises at least one of:

engaging the support member with the first brake; and engaging the tubular member with the second brake.

8. A method of radial expanding a tubular member, comprising:

coupling an expansion assembly to the tubular member, wherein the expansion assembly comprises a support member, an anchor and a die, wherein the support member extends through the anchor and the die, and wherein the support member is coupled to the tubular member;

restricting movement of the anchor relative to the tubular and support members while displacing the die through the tubular member to radially expand the tubular member; and restricting movement of the die relative to the tubular and support members while displacing the anchor through the tubular member, wherein:

the anchor comprises a first brake configured to selectively engage the support member and a second brake configured to selectively engage the tubular member;

the die comprises a third brake configured to selectively engage the support member and a fourth brake configured to selective engage the tubular member;

restricting movement of the anchor relative to the support member while displacing the die through the tubular member to radially expand the tubular member comprises:

engaging one of the support member and the tubular member with one of the first and second brakes;

disengaging the third brake from the support member; and disengaging the fourth brake from the tubular member; and restricting movement of the die relative to the support member while displacing the anchor through the tubular member comprises:

disengaging the first brake from the support member;

disengaging the second brake from the tubular member; and engaging one of the support member and the tubular member with one of the third and fourth brakes.

* * * * *